US011181033B2

(12) United States Patent
Sugiura

(10) Patent No.: US 11,181,033 B2
(45) Date of Patent: Nov. 23, 2021

(54) INTERNAL COMBUSTION ENGINE BODY

(71) Applicant: TOYOTA JIDOSHA KABUSHIKI KAISHA, Toyota (JP)

(72) Inventor: Yasuhiko Sugiura, Susono (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 11 days.

(21) Appl. No.: 16/506,105

(22) Filed: Jul. 9, 2019

(65) Prior Publication Data

US 2020/0080465 A1 Mar. 12, 2020

(30) Foreign Application Priority Data

Sep. 11, 2018 (JP) ..... JP2018-169738

(51) Int. Cl.

| | |
|---|---|
| ***F01P 3/02*** | (2006.01) |
| ***F02F 1/16*** | (2006.01) |
| ***F01P 3/00*** | (2006.01) |
| ***F02F 1/10*** | (2006.01) |

(52) U.S. Cl.

CPC ..... *F01P 3/02* (2013.01); *F02F 1/16* (2013.01); *F01P 2003/001* (2013.01); *F01P 2003/028* (2013.01); *F02F 2001/106* (2013.01)

(58) Field of Classification Search

CPC .. F01P 3/02; F01P 2003/001; F01P 2003/028; F02F 1/16; F02F 2001/106

See application file for complete search history.

(56) References Cited

U.S. PATENT DOCUMENTS

| | | | | |
|---|---|---|---|---|
| 5,558,048 | A * | 9/1996 | Suzuki | F02B 75/20 123/41.74 |
| 6,202,603 | B1 * | 3/2001 | Etemad | F01P 3/02 123/41.31 |
| 7,798,108 | B2 * | 9/2010 | Konishi | F02F 1/108 123/41.79 |
| 2014/0290600 | A1 | 10/2014 | Lee | |
| 2017/0167354 | A1 * | 6/2017 | Park | F02F 1/14 |
| 2017/0268406 | A1 * | 9/2017 | Lee | F02F 1/10 |

FOREIGN PATENT DOCUMENTS

| | | | | |
|---|---|---|---|---|
| CN | 102678368 | A * | 9/2012 | |
| CN | 102678368 | A | 9/2012 | |
| CN | 204572225 | U | 8/2015 | |
| JP | 2016-094872 | A | 5/2016 | |
| KR | 10-2013-0068863 | A | 6/2013 | |
| KR | 101393582 | B1 | 5/2014 | |
| WO | 2016/075521 | A1 | 5/2016 | |
| WO | 2017/068731 | A1 | 4/2017 | |
| WO | WO-2017104555 | A1 * | 6/2017 | F02F 1/00 |

* cited by examiner

*Primary Examiner* — Jacob M Amick
*Assistant Examiner* — Charles J Brauch
(74) *Attorney, Agent, or Firm* — Oliff PLC

(57) ABSTRACT

An internal combustion engine body includes a cylinder block including a plurality of cylinders, a first water jacket, and a second water jacket, and a cylinder head including an in-head water jacket. The in-head water jacket includes an intake-side flow passage. The cylinder block and the cylinder head are provided such that a flow rate of coolant that directly flows into the intake-side flow passage after flowing into the first water jacket is higher than a flow rate of coolant directly flows into any region other than the intake-side flow passage after flowing into the first water jacket.

16 Claims, 16 Drawing Sheets

INTERNAL COMBUSTION ENGINE BODY

INCORPORATION BY REFERENCE

The disclosure of Japanese Patent Application No. 2018-169738 filed on Sep. 11, 2018 including the specification, drawings and abstract is incorporated herein by reference in its entirety.

BACKGROUND

1. Technical Field

The disclosure relates to an internal combustion engine body that includes a cylinder block and a cylinder head.

2. Description of Related Art

Conventionally, there has been known a cooling system in which water jackets are provided in a cylinder block and a cylinder head of an internal combustion engine body respectively, and the cylinder block and the cylinder head are cooled by circulating coolant through these water jackets (e.g., Japanese Patent Application Publication No. 2016-094872 (JP 2016-094872 A)).

In particular, a cooling system described in Japanese Patent Application Publication No. 2016-094872 (JP 2016-094872 A) includes two independent circulation systems. The first circulation system includes a first water jacket that is provided in a cylinder head. The second circulation system includes a second water jacket that is provided in the cylinder head, and a third water jacket that is provided in a cylinder block. In the cooling system thus configured, the temperatures of coolant can be controlled in the first circulation system and the second circulation system separately from each other. Therefore, the temperature of the cylinder head and the temperature of the cylinder block can be controlled independently of each other, in accordance with the operating state of an internal combustion engine.

SUMMARY

The cooling system described in Japanese Patent Application Publication No. 2016-094872 (JP 2016-094872 A) includes the two independent circulation systems, and each of the circulation systems has a radiator and a water pump. Therefore, the cooling system described in Japanese Patent Application Publication No. 2016-094872 (JP 2016-094872 A) is complicated in configuration and high in the cost of manufacturing.

The disclosure provides an internal combustion engine body in which a cooling system is simplified in structure while appropriately cooling a cylinder head and a cylinder block.

An internal combustion engine body according to a first aspect of the disclosure includes a cylinder block including a first water jacket and a second water jacket that are provided around a plurality of cylinders, and a cylinder head including an in-head water jacket. The in-head water jacket includes an intake-side flow passage that communicates with the first water jacket and the second water jacket and that is provided around an intake port. At least part of the first water jacket is provided on intake sides of the plurality of the cylinders. At least part of the second water jacket is provided on exhaust sides of the plurality of the cylinders. The first water jacket has an inflow port into which coolant flows from an outside of the internal combustion engine body. The cylinder block and the cylinder head are provided such that a flow rate of the coolant that flows into the intake-side flow passage after flowing into the first water jacket is higher than a flow rate of the coolant directly flows into any region other than the intake-side flow passage after flowing into the first water jacket. Each of the intake sides is a side where the intake port is provided with respect to a plane containing axes of the plurality of the cylinders in a direction perpendicular to the plane, and each of the exhaust sides is a side where an exhaust port is provided with respect to the plane.

An internal combustion engine body according to a second aspect of the disclosure includes a cylinder block including a first water jacket and a second water jacket that are provided around a plurality of cylinders, and a cylinder head including an in-head water jacket. The in-head water jacket includes an intake-side flow passage that communicates with the first water jacket and the second water jacket and that is provided around an intake port. At least part of the first water jacket is provided on intake sides of the plurality of the cylinders. At least part of the second water jacket is provided on exhaust sides of the plurality of the cylinders. The first water jacket has an inflow port into which coolant flows from an outside of the internal combustion engine body. The cylinder block and the cylinder head are provided such that a total flow passage cross-sectional area of flow passages through which the coolant passes when the coolant flows out from the first water jacket to the intake-side flow passage is larger than a total flow passage cross-sectional area of flow passages through which the coolant passes when the coolant flows out from the first water jacket to any region other than the intake-side flow passage. Each of the intake sides is a side where the intake port is provided with respect to a plane containing axes of the plurality of the cylinders in a direction perpendicular to the plane, and each of the exhaust sides is a side where an exhaust port is provided with respect to the plane.

In each of the aforementioned first and second aspects, the first water jacket and the second water jacket may be provided in such a manner as not to directly communicate with each other.

In each of the aforementioned first and second aspects, the cylinder block may include a small-diameter flow passage having a maximum diameter that is smaller than a minimum thickness between adjacent ones of the cylinders, the small-diameter flow passage may communicate with the first water jacket and the second water jacket or communicate with a region of the in-head water jacket other than the intake-side flow passage, and the cylinder block may be provided such that the coolant flows out from the first water jacket only to the intake-side flow passage and the small-diameter flow passage.

In each of the aforementioned first and second aspects, a plurality of the small-diameter flow passages may be provided.

In each of the aforementioned first and second aspects, the intake-side flow passage may include an inter-intake port flow passage that extends across an area between a plurality of intake ports that communicate with one of the cylinders.

In each of the aforementioned first and second aspects, the intake-side flow passage may include an intake inter-cylinder flow passage that extends across an area between two adjacent ones of the intake ports that communicate with adjacent ones of the cylinders respectively.

In each of the aforementioned first and second aspects, the in-head water jacket may include an inter-exhaust port flow passage that extends across an area between a plurality of exhaust ports that communicate with one of the cylinders.

In each of the aforementioned first and second aspects, the in-head water jacket may not be provided with a flow passage that extends across an area between two adjacent ones of the exhaust ports that communicate with adjacent ones of the cylinders respectively.

In each of the aforementioned first and second aspects, the in-head water jacket may include a first exhaust-side flow passage including a portion that is located closer to the cylinder block than the exhaust port is, and a second exhaust-side flow passage including a portion that is located on an opposite side of the exhaust port from the cylinder block, and the cylinder head may be provided such that both the first exhaust-side flow passage and the second exhaust-side flow passage communicate with the intake-side flow passage, and that a flow rate of the coolant flowing from the intake-side flow passage into the first exhaust-side flow passage is higher than a flow rate of the coolant flowing from the intake-side flow passage into the second exhaust-side flow passage.

In each of the aforementioned first and second aspects, the second water jacket may not be provided with an inflow port into which coolant flows from the outside of the internal combustion engine body.

According to the disclosure, there is provided an internal combustion engine body in which a cooling system is simplified in structure while appropriately cooling a cylinder head and a cylinder block.

BRIEF DESCRIPTION OF THE DRAWINGS

Features, advantages, and technical and industrial significance of an exemplary embodiment of the disclosure will be described below with reference to the accompanying drawings, in which like numerals denote like elements, and wherein.

DETAILED DESCRIPTION OF EMBODIMENT

Figure 1:
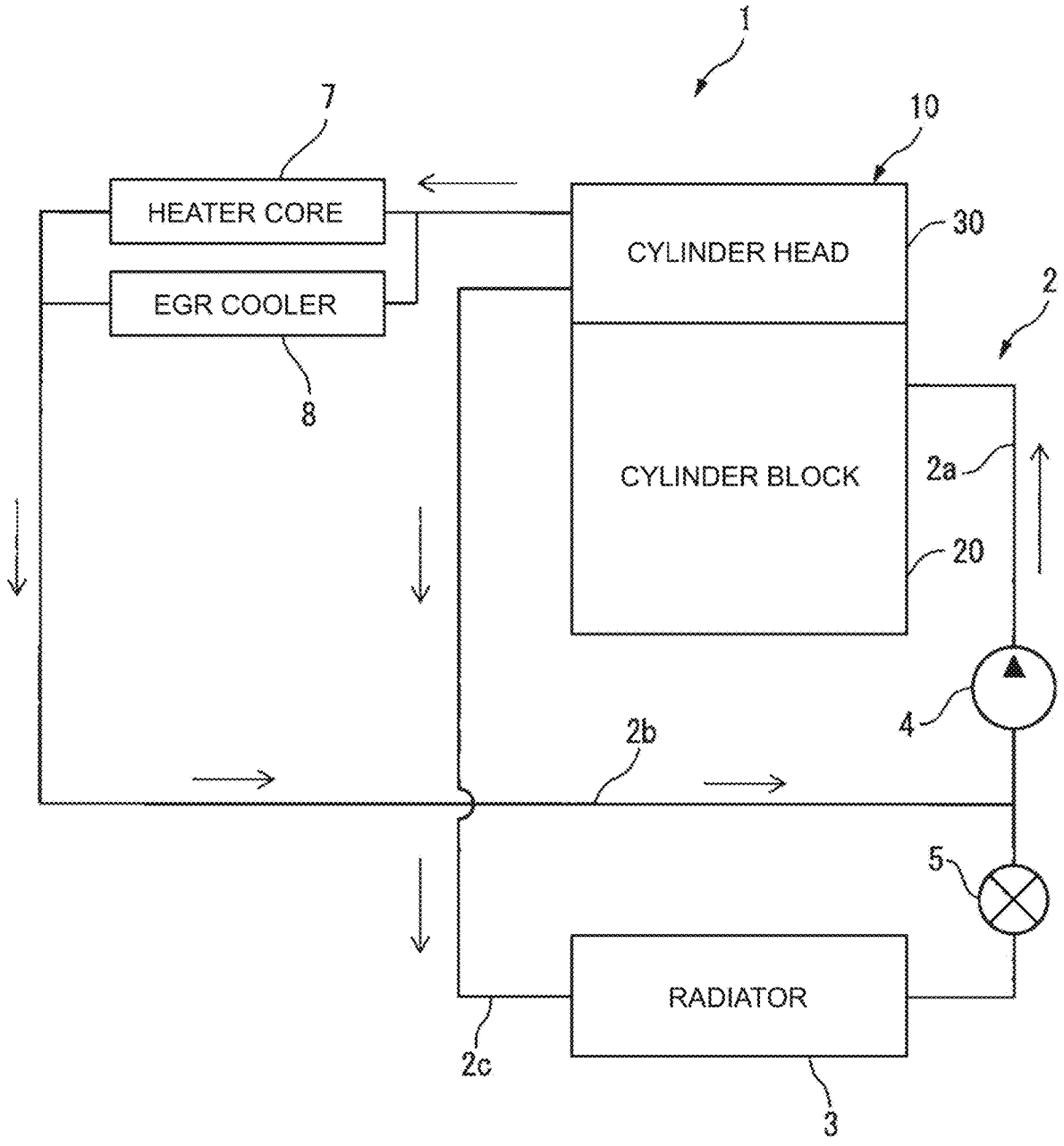
FIG. 1 is a view schematically showing the configuration of a cooling system for an internal combustion engine according to the embodiment.

The embodiment of the disclosure will be described hereinafter in detail with reference to the drawings. Incidentally, in the following description, like components are denoted by like reference numerals.

The configuration of a cooling system for an internal combustion engine according to the embodiment will be described with reference to FIG. 1. FIG. 1 is a view schematically showing the configuration of the cooling system for the internal combustion engine according to the present embodiment.

As shown in FIG. 1, an engine body (an internal combustion engine body) 10 includes a cylinder block 20 and a cylinder head 30. A plurality of cylinders are provided in the cylinder block 20, and pistons move in a reciprocating manner within these cylinders respectively. A mixture of fuel and air is burned in the plurality of the cylinders, and a power is thereby taken out.

Besides, as shown in FIG. 1, a cooling system 1 for an internal combustion engine includes a circulation passage 2, a radiator 3, a water pump 4, and a thermostat 5. The circulation passage 2 includes a coolant introduction passage 2*a* through which the coolant discharged from the water pump 4 and flowing into the engine body 10 passes, and two coolant discharge passages 2*b* and 2*c* through which the coolant discharged from the engine body 10 and flowing into the water pump 4 flows.

The coolant introduction passage 2*a* communicates at one end thereof with an outlet of the water pump 4, and communicates at the other end thereof with an inflow port of the engine body 10. Each of the coolant discharge passages 2*b* and 2*c* communicates at one end thereof with an outflow port of the engine body 10, and communicates at the other end thereof with an inlet of the water pump 4. In an example shown in FIG. 1, the first coolant discharge passage 2*b* communicates with the water pump 4 from the cylinder head 30 via other components such as a heater core 7, an EGR cooler 8, and the like.

The heater core 7 is used to heat a vehicle cabin of a vehicle that is provided with the internal combustion engine. By causing the coolant that has been warmed through the engine body 10 to flow to the heater core 7, the vehicle cabin can be warmed through heat exchange. On the other hand, the EGR cooler 8 is provided in an EGR passage for supplying part of exhaust gas in the internal combustion engine to an intake passage as EGR gas, and is used to cool the EGR gas flowing through the EGR passage. By causing coolant to flow to the EGR cooler, the high-temperature EGR gas discharged from the internal combustion engine can be cooled.

The second coolant discharge passage 2*c* communicates with the water pump 4 from the cylinder head 30 via the radiator 3. The radiator 3 is provided in the second coolant discharge passage 2*c*, and the thermostat 5 is provided in the second coolant discharge passage 2*c* at a position downstream of the radiator 3.

The radiator 3 cools the coolant flowing in the radiator 3, by the traveling wind of the vehicle provided with the internal combustion engine or the wind produced by a fan (not shown) provided adjacent to the radiator 3. The water pump 4 force-feeds the coolant such that the coolant circulates in the circulation passage 2.

The thermostat 5 is a valve that is automatically opened/closed in accordance with a temperature of coolant flowing in the coolant discharge passage 2*b* at a merging point of a branched passage (the second coolant discharge passage) 2*c*. In the present embodiment in particular, the thermostat 5 is configured to be opened when the temperature of coolant flowing in the coolant discharge passage 2*b* is equal to or higher than a predetermined temperature, and to be closed when the temperature of coolant flowing in the coolant discharge passage 2*b* is lower than the predetermined temperature. When the thermostat 5 is opened, the coolant that has been cooled through the radiator 3 flows into the water pump 4. On the other hand, when the thermostat 5 is closed, the coolant that has flowed from the cylinder head 30 through the coolant discharge passage 2*b* flows into the water pump 4, and the coolant that has been cooled through the radiator 3 does not flow into the water pump 4.

In the cooling system configured as described above, the coolant force-fed by the water pump 4 flows into the engine body 10 through the coolant introduction passage 2*a*, and cools the engine body 10. The coolant that has been warmed by cooling the engine body 10 is returned to the water pump 4 through the coolant discharge passage 2*b*. At this time, part of the coolant that has flowed out from the engine body 10 is returned to the water pump 4 through other components such as the heater core 7, the EGR cooler 8, and the like. In addition, when the temperature of the coolant returned to the water pump 4 is equal to or higher than a predetermined temperature, the thermostat 5 is opened, so part of the coolant flows into the water pump 4 after being cooled through the radiator 3. The coolant that has thus returned to the water pump 4 is supplied again to the engine body 10. Thus, the coolant circulates in the cooling system.

The cooling system according to the present embodiment includes only one circulation system having one radiator and one water pump. Accordingly, the configuration of the cooling system can be made simpler than the configuration of a cooling system that includes two independent circulation systems. Thus, the cost of manufacturing can be held low.

Next, the configurations of the cylinder block 20 and the cylinder head 30 of the engine body 10 will be described with reference to FIGS. 2 to 8. In the present embodiment, the internal combustion engine is an in-line four-cylinder internal combustion engine. That is, four cylinders 21, namely, first to fourth cylinders 21#1 to 21#4 are provided in a row in the cylinder block 20.

In the present specification, the orientation in the engine body 10 is defined based on the orientation in the case where the engine body 10 is viewed from a front side of a vehicle that is provided with a transversely provided internal combustion engine. Accordingly, in the present specification, in an axial direction of the cylinders 21 of the internal combustion engine, an orientation from the cylinder block 20 toward the cylinder head 30 is referred to as an upward direction (an upper side), and an orientation from the cylinder head 30 toward the cylinder block 20 is referred to as a downward direction (a lower side). However, the engine body 10 should not necessarily be arranged such that axes of the cylinders 21 extend in a vertical direction. For example, the engine body 10 may be arranged such that the axes of the cylinders 21 extend in a horizontal direction.

Besides, in the present specification, in a direction perpendicular to a plane containing the axes of the plurality of the cylinders 21, a side where intake ports are provided with respect to this plane is referred to as a front side (an intake side), and a side where exhaust ports are provided with respect to this plane is referred to as a rear side (an exhaust side). In addition, in an alignment direction of the cylinders 21, a side where the first cylinder 21#1 is provided is referred to as a left side (the first cylinder side), and a side where the fourth cylinder 21#4 is provided is referred to as a right side (the fourth cylinder side). However, the engine body 10 may be arranged in the vehicle in various orientations different from the aforementioned directions. Accordingly, the engine body 10 may be arranged with respect to the vehicle such that a longitudinal direction and a lateral direction of the engine body 10 are reverse to the aforementioned directions respectively. The engine body 10 may be longitudinally arranged such that the aforementioned longitudinal direction of the engine body 10 is equivalent to a lateral direction of the vehicle, and that the aforementioned lateral direction of the engine body 10 is equivalent to a longitudinal direction of the vehicle.

In addition, in the present specification, a cross-section of a flow passage for coolant that is perpendicular to a direction in which a main stream of the coolant flows is referred to as a flow passage cross-section, and a cross-sectional area thereof is referred to as a flow passage cross-sectional area.

Figure 2:
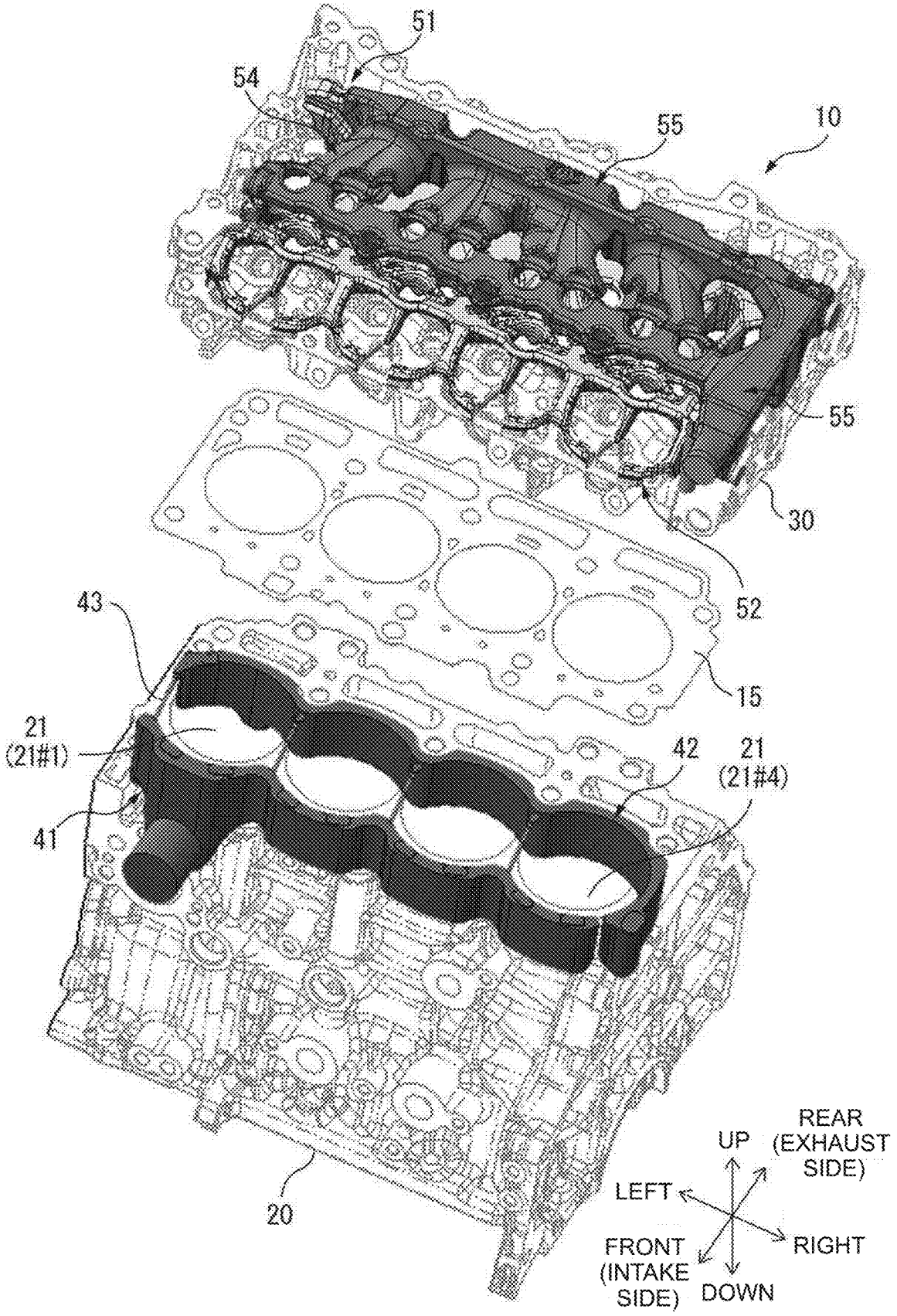
FIG. 2 is a perspective view schematically showing a cylinder block and a cylinder head.

FIG. 2 is a perspective view schematically showing the cylinder block 20 and the cylinder head 30. In the drawing, contours of the cylinder block 20 and the cylinder head 30 are indicated by thin lines. On the other hand, in the drawing, spots painted gray with different concentrations indicate water jackets (i.e., spaces through which coolant flows) that are provided in the cylinder block 20 and the cylinder head 30 respectively.

Figure 3:
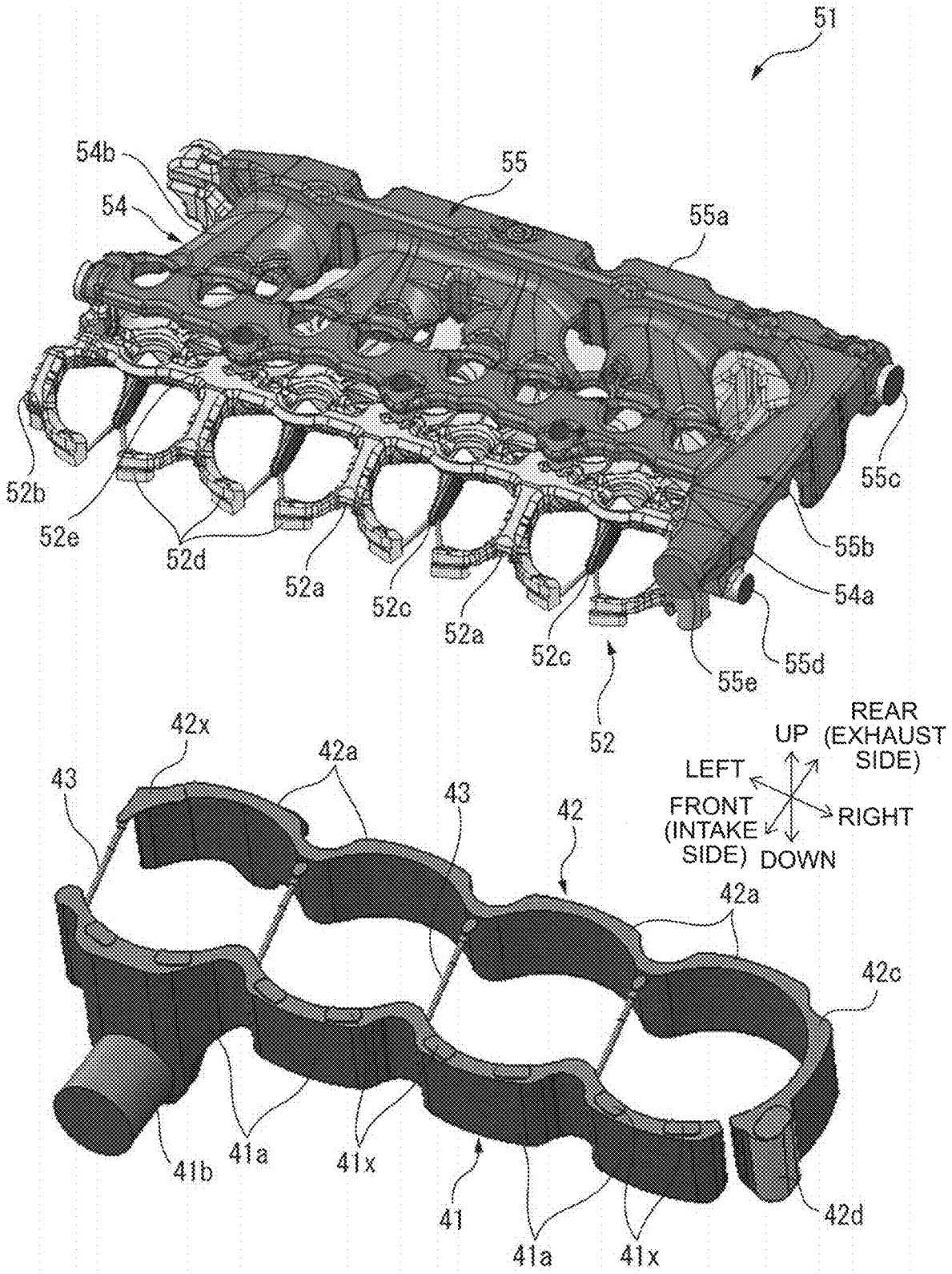
FIG. 3 is a perspective view similar to FIG. 2, showing only water jackets that are provided in the cylinder block and the cylinder head respectively.

FIG. 3 is a perspective view that is obtained by extracting only the water jackets that are provided in the cylinder block 20 and the cylinder head 30 respectively from the perspective view of FIG. 2. In FIG. 3, the water jacket that is provided in the cylinder block 20, and the water jacket that is provided in the cylinder head 30 are depicted apart from each other.

Figure 4:
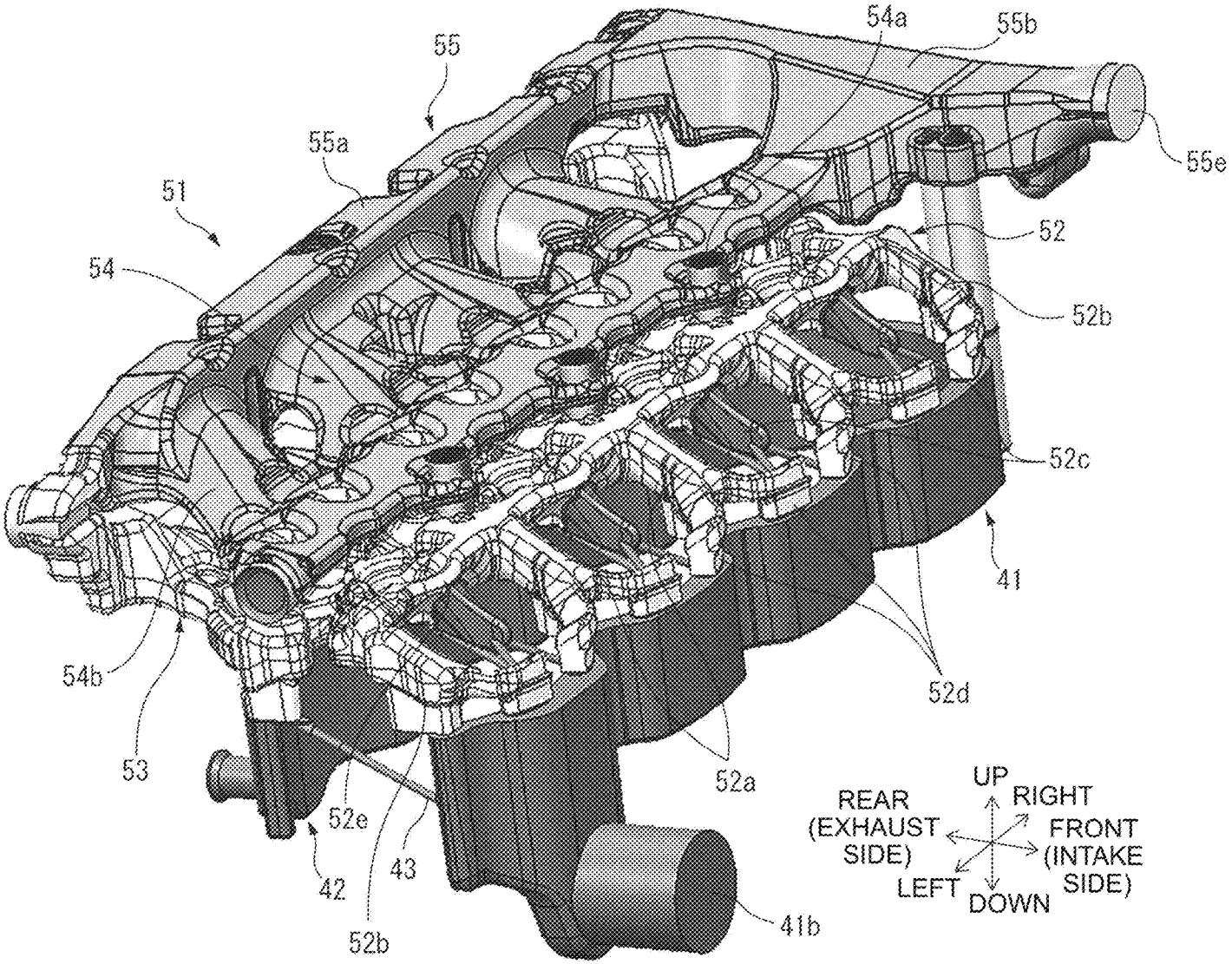
FIG. 4 is a perspective view of the water jackets that are provided in the cylinder block and the cylinder head respectively, as viewed from a front upper-left side.
Figure 5:
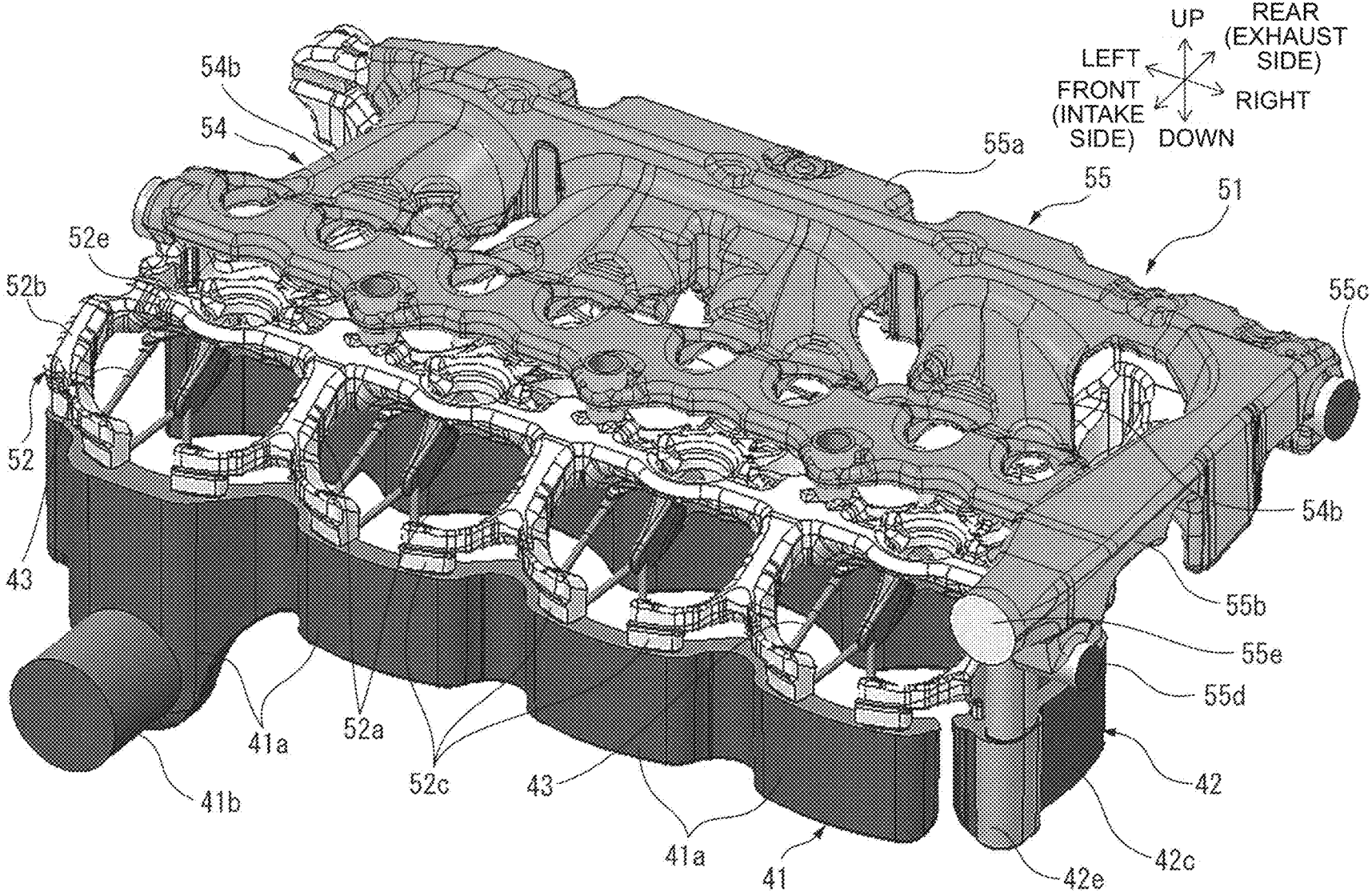
FIG. 5 is a perspective view of the water jackets that are provided in the cylinder block and the cylinder head respectively, as viewed from a front upper-right side.

Each of FIGS. 4 and 5 is a perspective view of the water jackets that are provided in the cylinder block 20 and the cylinder head 30 respectively. FIG. 4 is a perspective view of the water jackets as viewed from a front upper-left side, and FIG. 5 is a perspective view of the water jackets as viewed from a front upper-right side.

Figure 6:
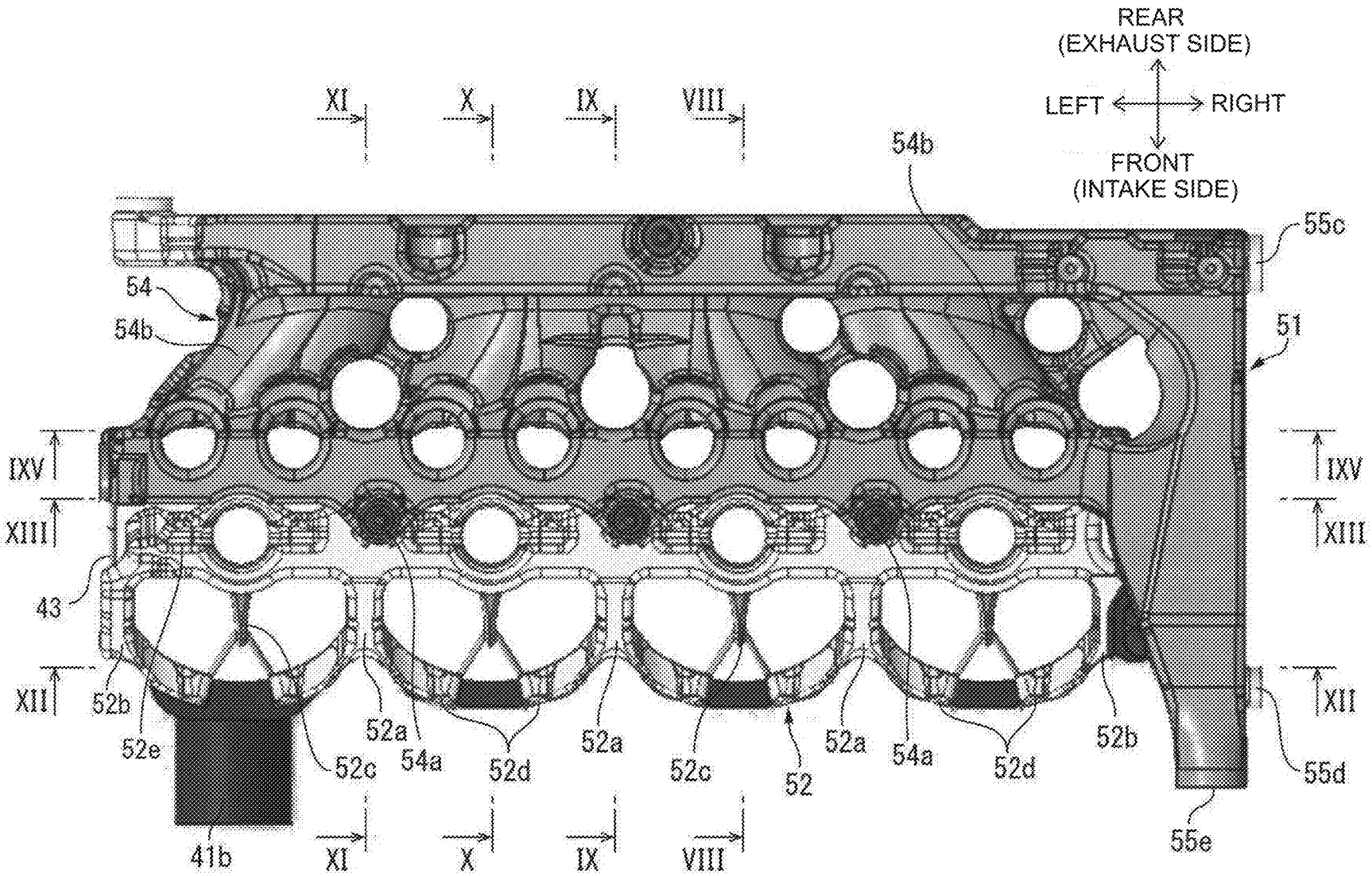
FIG. 6 is a top view of the water jackets that are provided in the cylinder block and the cylinder head respectively, as viewed from above.

FIG. 6 is a top view of the water jackets that are provided in the cylinder block 20 and the cylinder head 30 respectively, as viewed from above. Besides, FIG. 7 is a bottom view of the water jackets that are provided in the cylinder block 20 and the cylinder head 30 respectively, as viewed from below.

Figure 7:
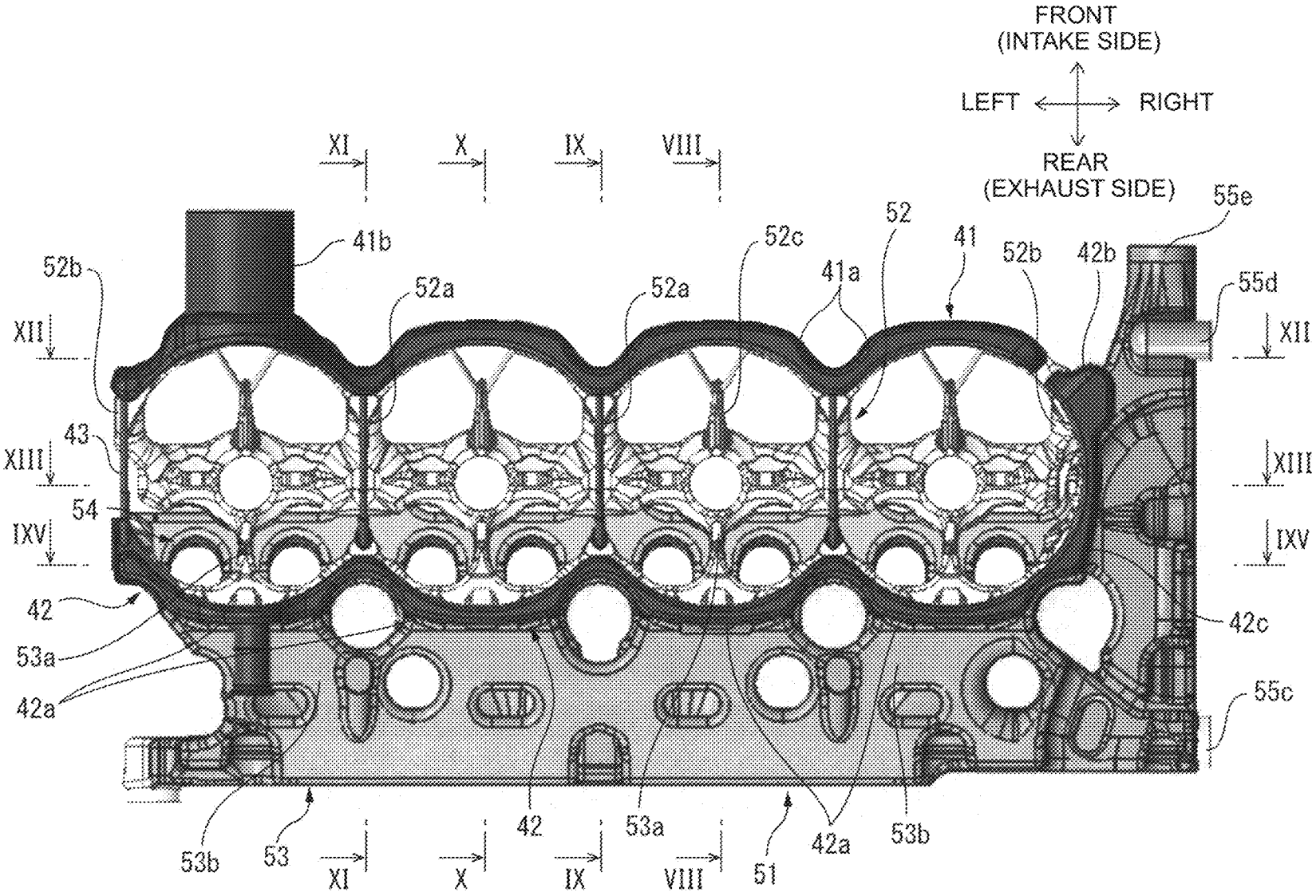
FIG. 7 is a bottom view of the water jackets that are provided in the cylinder block and the cylinder head respectively, as viewed from below.
Figure 8:
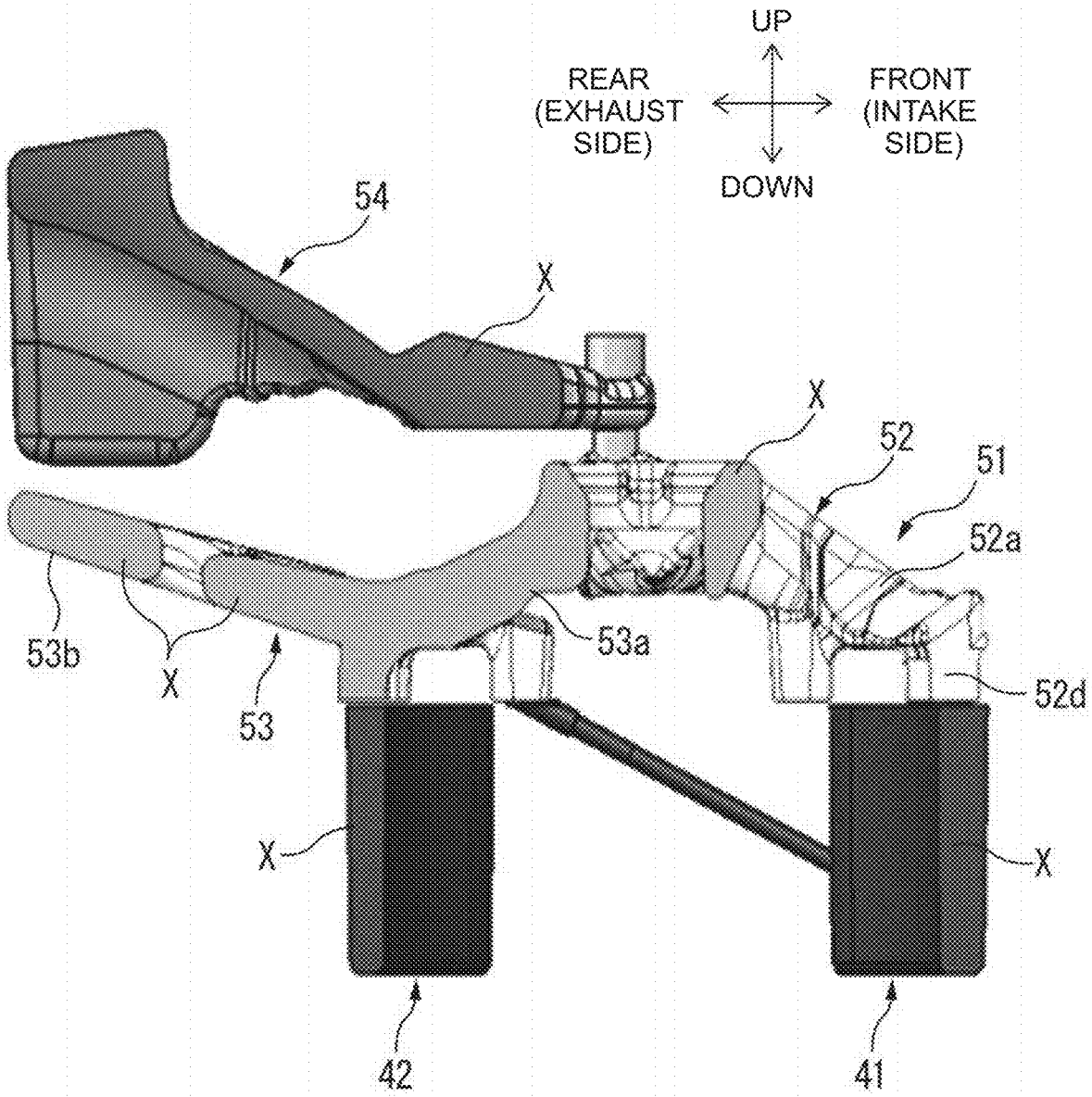
FIG. 8 is a cross-sectional view of the water jackets that are provided in the cylinder block and the cylinder head respectively, as viewed along a line VIII-VIII in FIGS. 6 and 7.

FIG. 8 is a cross-sectional view of the water jackets that are provided in the cylinder block 20 and the cylinder head 30 respectively, as viewed along a line VIII-VIII in FIGS. 6 and 7. In the drawing, spaces in the water jackets are denoted by X.

As shown in FIG. 2, the engine body 10 includes the cylinder block 20, a head gasket 15, and the cylinder head 30. The cylinder block 20 and the cylinder head 30 are formed of a known material such as cast iron, aluminum or the like. The head gasket 15 is formed of known materials such as stacked metals or the like. The head gasket 15 is arranged between the cylinder block 20 and the cylinder head 30.

As shown in FIGS. 2 to 5 and FIGS. 7 and 8, the cylinder block 20 includes a first water jacket 41, a second water jacket 42, and a plurality of small-diameter flow passages 43.

The first water jacket 41 is provided on the front sides (the intake sides) of the plurality of the cylinders 21. The first water jacket 41 includes intake-side extended flow passages 41*a* and an inflow port 41*b*. Each of the intake-side extended flow passages 41*a* extends in a circumferential direction partially along an outer periphery of the corresponding one of the cylinders 21, on the intake side of the corresponding one of the cylinders 21, on a cross-section perpendicular to the corresponding one of the cylinders 21. The intake-side extended flow passages 41*a* that are provided on the intake sides of adjacent ones of the cylinders 21 communicate with each other. Accordingly, the intake-side extended flow passages 41*a* extend from the intake side of the first cylinder 21#1 to the intake side of the fourth cylinder 21#4.

Besides, each of the intake-side extended flow passages 41*a* is provided in the cylinder block 20 in such a manner as to extend downward in the axial direction of the cylinders 21 from an upper surface of the cylinder block 20 (a surface facing the cylinder head 30) or a vicinity of the upper surface thereof. In the present embodiment, part of an upper portion of each of the intake-side extended flow passages 41*a* of the first water jacket 41 (an opening 41*x* in FIG. 3) is exposed to the upper surface of the cylinder block 20, on the front side of the corresponding one of the cylinders 21. Each of the intake-side extended flow passages 41*a* exposed to the upper surface of the cylinder block 20 communicates with an opening that is provided through the gasket 15. For example, each of the intake-side extended flow passages 41*a* extends downward over about ⅓ of a length in the axial direction of the cylinders 21 from the upper surface of the cylinder block 20 (the surface facing the cylinder head 30) or the vicinity of the upper surface thereof. In the present embodiment, the length of the intake-side extended flow passage 41*a* that is located on the exhaust side of the first cylinder 21#1 is longer than the length of the intake-side extended flow passages 41*a* that are located on the exhaust sides of the other cylinders 21, in the axial direction of the cylinders 21. Accordingly, the intake-side extended flow passage 41*a* that is located on the exhaust side of the first cylinder 21#1 extends further downward than the intake-side extended flow passages 41*a* that are located on the exhaust sides of the other cylinders 21.

The inflow port 41*b* is provided in such a manner as to communicate at one end portion thereof with the intake-side extended flow passages 41*a*, and to communicate at the other end portion thereof with an outside of the cylinder block 20. Accordingly, the inflow port 41*b* is exposed to a lateral surface of the cylinder block 20. In the present embodiment, the inflow port 41*b* is provided in such a manner as to communicate with the intake-side extended flow passage 41*a* on the intake side of the first cylinder 21#1. Besides, the inflow port 41*b* communicates with the coolant introduction passage 2*a*. Accordingly, the coolant discharged from the water pump 4 flows into the inflow port 41*b* from an outside of the engine body 10.

On the other hand, the second water jacket 42 is provided on the exhaust sides of the plurality of the cylinders 21. The second water jacket 42 includes exhaust-side extended flow passages 42*a*, a lateral extended flow passage 42*c*, and a discharge portion 42*d* (see FIGS. 3, 4, and 7 in particular). The second water jacket 42 is not provided with an inflow port into which coolant flows from the outside of the engine body 10.

Each of the exhaust-side extended flow passages 42*a* extends in the circumferential direction partially along the outer periphery of the corresponding one of the cylinders 21, on the exhaust side of the corresponding one of the cylinders 21, on the cross-section perpendicular to the corresponding one of the cylinders 21. The exhaust-side extended flow passages 42*a* that are provided on the exhaust sides of adjacent ones of the cylinders 21 communicate with each other. Accordingly, the exhaust-side extended flow passages 42*a* extend from the exhaust side of the first cylinder 21#1 to the exhaust side of the fourth cylinder 21#4.

Besides, each of the exhaust-side extended flow passages 42*a* is provided in the cylinder block 20 in such a manner as to extend downward in the axial direction of the cylinders 21 from the upper surface of the cylinder block 20 or the vicinity of the upper surface thereof. In the present embodiment, part of an upper portion of each of the exhaust-side extended flow passages 42*a* of the second water jacket 42 (an opening 42*x* in FIG. 3) is exposed to the upper surface of the cylinder block 20, at the left end portion of each of the exhaust-side extended flow passages 42*a*. Each of the exhaust-side extended flow passages 42*a* exposed to the upper surface of the cylinder block 20 communicates with an opening that is provided in the gasket 15. For example, each of the exhaust-side extended flow passages 42*a* extends downward over about ⅓ of the length in the axial direction of the cylinders 21 from the upper surface of the cylinder block 20 or the vicinity of the upper surface thereof.

The lateral extended flow passage 42*c* communicates at an end on the exhaust side thereof with a right end of the corresponding exhaust-side extended flow passage 42*a*, and is provided on the right side of the fourth cylinder 21#4. The lateral extended flow passage 42*c* partially extends along the outer periphery of the fourth cylinder 21#4, on the right side of the fourth cylinder 21#4, on the cross-section perpendicular to each of the cylinders 21.

The discharge portion 42*d* is held in communication with an end (an end on the intake side) of the lateral extended flow passage 42*c* that is located on the opposite side of an end thereof on the exhaust-side extended flow passage 42*a* side. The discharge portion 42*d* is provided in the cylinder block 20 in such a manner as to extend downward in the axial direction of the cylinders 21 from the upper surface of the cylinder block 20. Accordingly, the discharge portion 42*d* is exposed to the upper surface of the cylinder block 20. The discharge portion 42*d* exposed to the upper surface of the cylinder block 20 communicates with the opening that is provided in the gasket 15.

The first water jacket 41 and the second water jacket 42 are provided in such a manner as not to directly communicate with each other. Accordingly, the left end portion of the intake-side extended flow passage 41*a* of the first water jacket 41 and the left end portion of the exhaust-side extended flow passage 42*a* of the second water jacket 42 do not directly communicate with each other. Similarly, the right end portion of the intake-side extended flow passage 41*a* of the first water jacket 41 and the lateral extended flow passage 42*c* of the second water jacket 42 do not directly communicate with each other.

The small-diameter flow passages 43 are provided in such a manner as to extend in the longitudinal direction on the left side of the first cylinder 21#1 that is located on the leftmost side, between two adjacent ones of the cylinders 21. In the present embodiment, each of the small-diameter flow passages 43 communicates at one end thereof with the first water jacket 41 below the first water jacket 41, and is located at the other end thereof on the upper surface of the cylinder block 20. Accordingly, the small-diameter flow passages 43 are exposed to the upper surface of the cylinder block 20. Each of the small-diameter flow passages 43 exposed to the upper surface of the cylinder block 20 communicates with the opening provided in the gasket 15. The small-diameter flow passages 43 are provided in such a manner as to communicate with a first exhaust-side flow passage 53 of an in-head water jacket 51 that is provided in the cylinder head 30 when the cylinder head 30 is assembled with the cylinder block 20 (see FIG. 8). Although the plurality of the small-diameter flow passages 43 are provided in the present embodiment, the number of small-diameter flow passages 43 should not be limited. It is sufficient to provide at least one small-diameter flow passage 43.

Each of the small-diameter flow passages 43 has a maximum diameter that is smaller than a minimum thickness of the cylinder block 20 between adjacent ones of the cylinders 21. In the present embodiment, each of the small-diameter flow passages 43 is rectilinearly provided, and is provided by, for example, drilling a hole through the cylinder block 20 after molding the cylinder block 20 through casting.

In the present embodiment, each of the small-diameter flow passages 43 is provided in such a manner as to be located at the other end thereof on the upper surface of the cylinder block 20 and communicate at the other end thereof with the in-head water jacket 51. However, each of the small-diameter flow passages 43 may be provided in such a manner as to communicate at the other end portion thereof with the second water jacket 42.

Besides, the second water jacket 42 may not include the lateral extended flow passage 42*c*. Besides, the first water jacket 41 may include a lateral extended flow passage that communicates with the intake-side extended flow passages 41*a* and that is provided on the left side of the first cylinder 21#1 or the right side of the fourth cylinder 21#4. In any case, at least part of the first water jacket 41 is provided on the intake sides of the plurality of the cylinders 21, and at least part of the second water jacket 42 is provided on the exhaust sides of the plurality of the cylinders 21. However, that the first water jacket 41 and the second water jacket 42 may be provided in such a manner as not to directly communicate with each other.

Next, the in-head water jacket 51 that is provided in the cylinder head 30 will be described with reference to FIGS. 9 to 14 as well as FIGS. 2 to 8.

Figure 9:
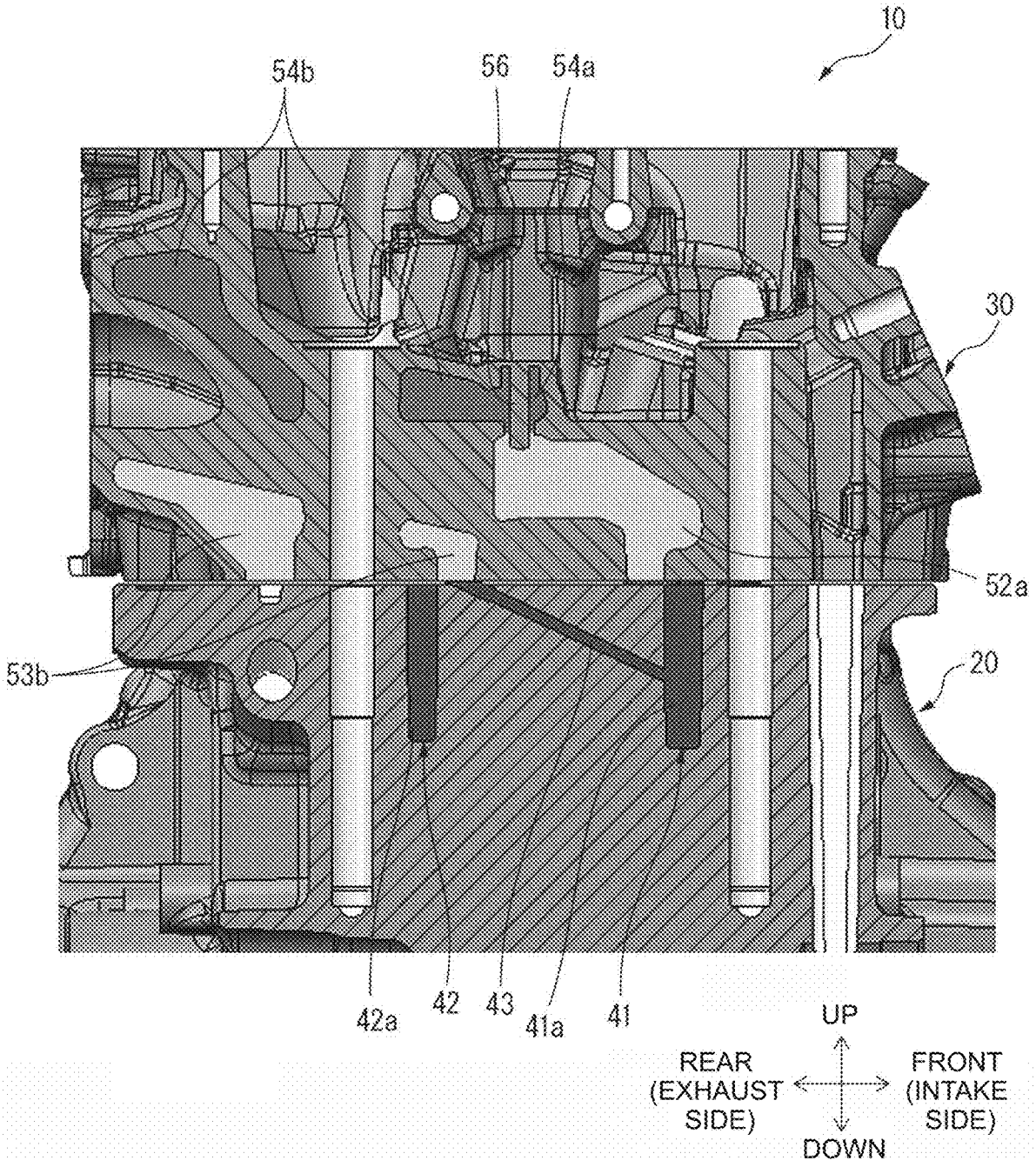
FIG. 9 is a cross-sectional view of the cylinder block and the cylinder head, as viewed along a line IX-IX in FIGS. 6 and 7.
Figure 10:
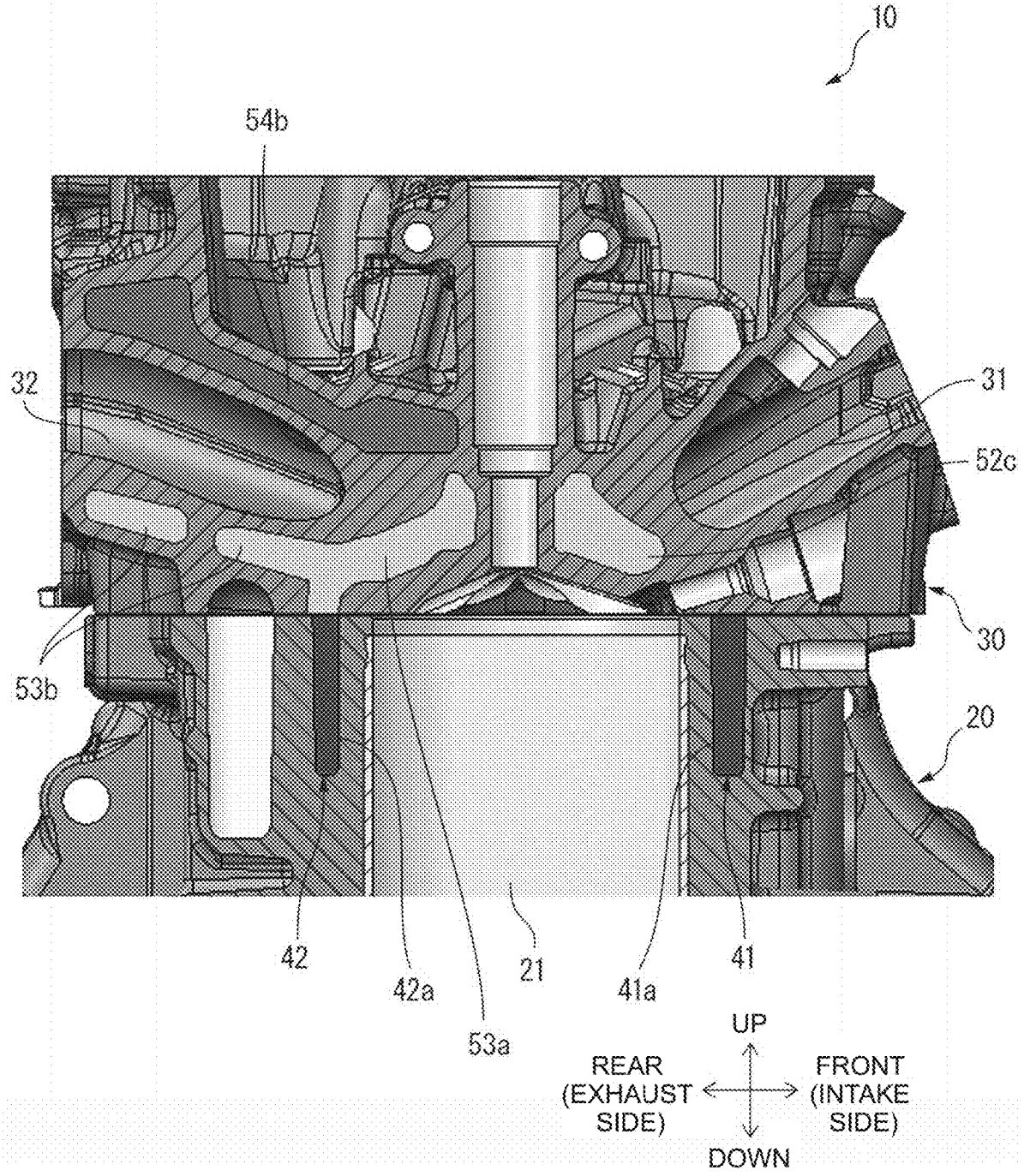
FIG. 10 is a cross-sectional view of the cylinder block and the cylinder head, as viewed along a line X-X in FIGS. 6 and 7.
Figure 11:
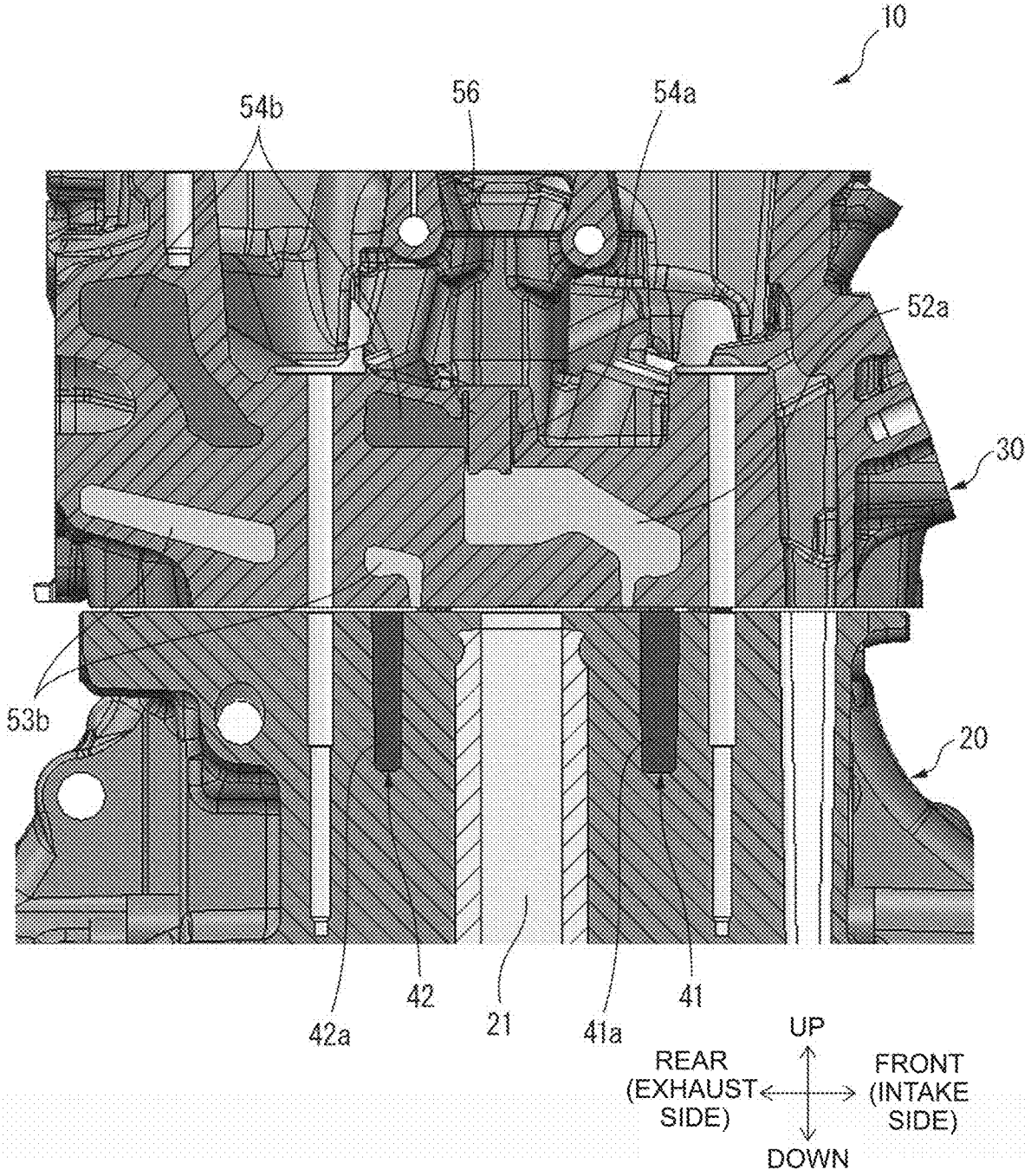
FIG. 11 is a cross-sectional view of the cylinder block and the cylinder head, as viewed along a line XI-XI in FIGS. 6 and 7.
Figure 12:
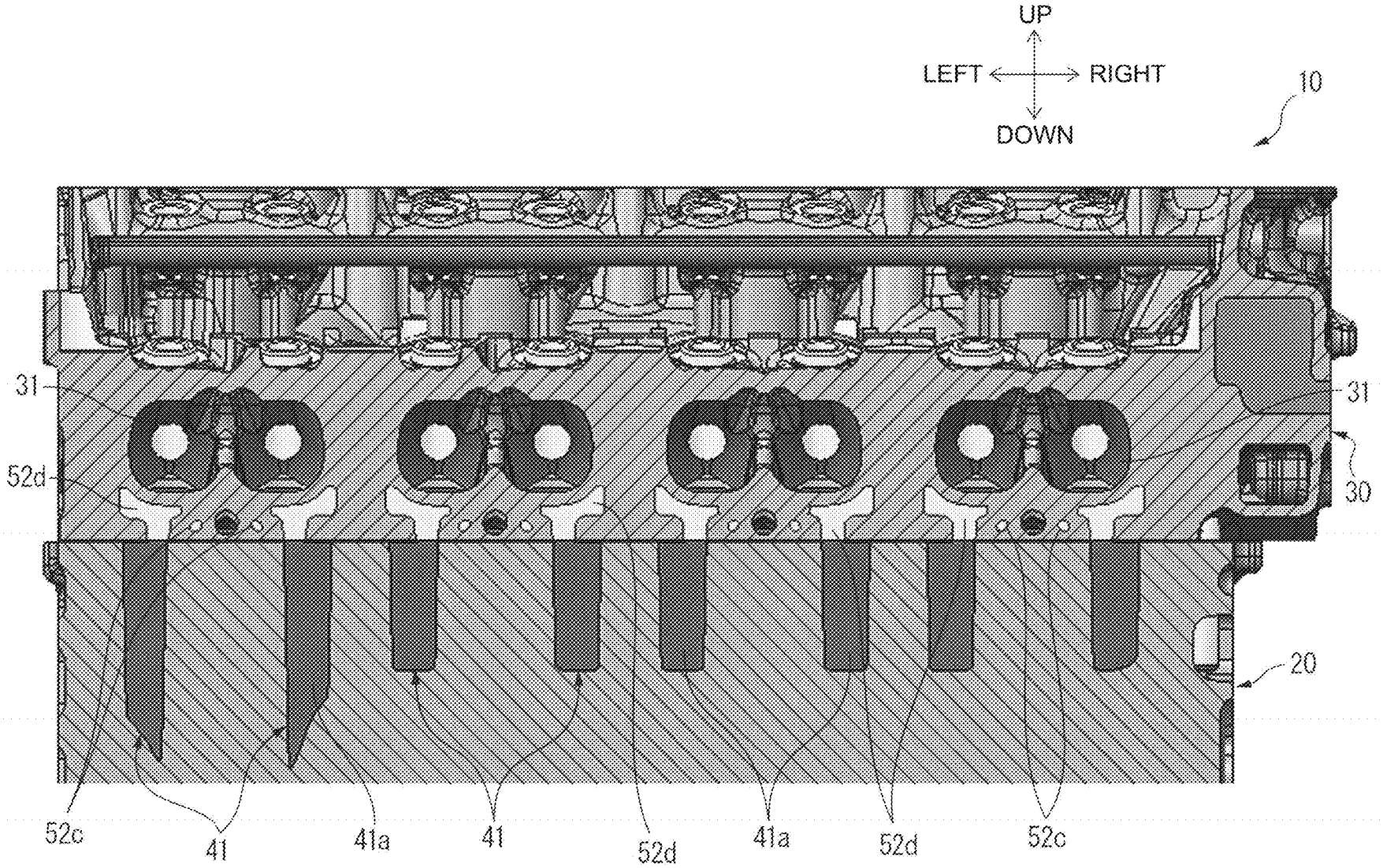
FIG. 12 is a cross-sectional view of the cylinder block and the cylinder head, as viewed along a line XII-XII in FIGS. 6 and 7.
Figure 13:
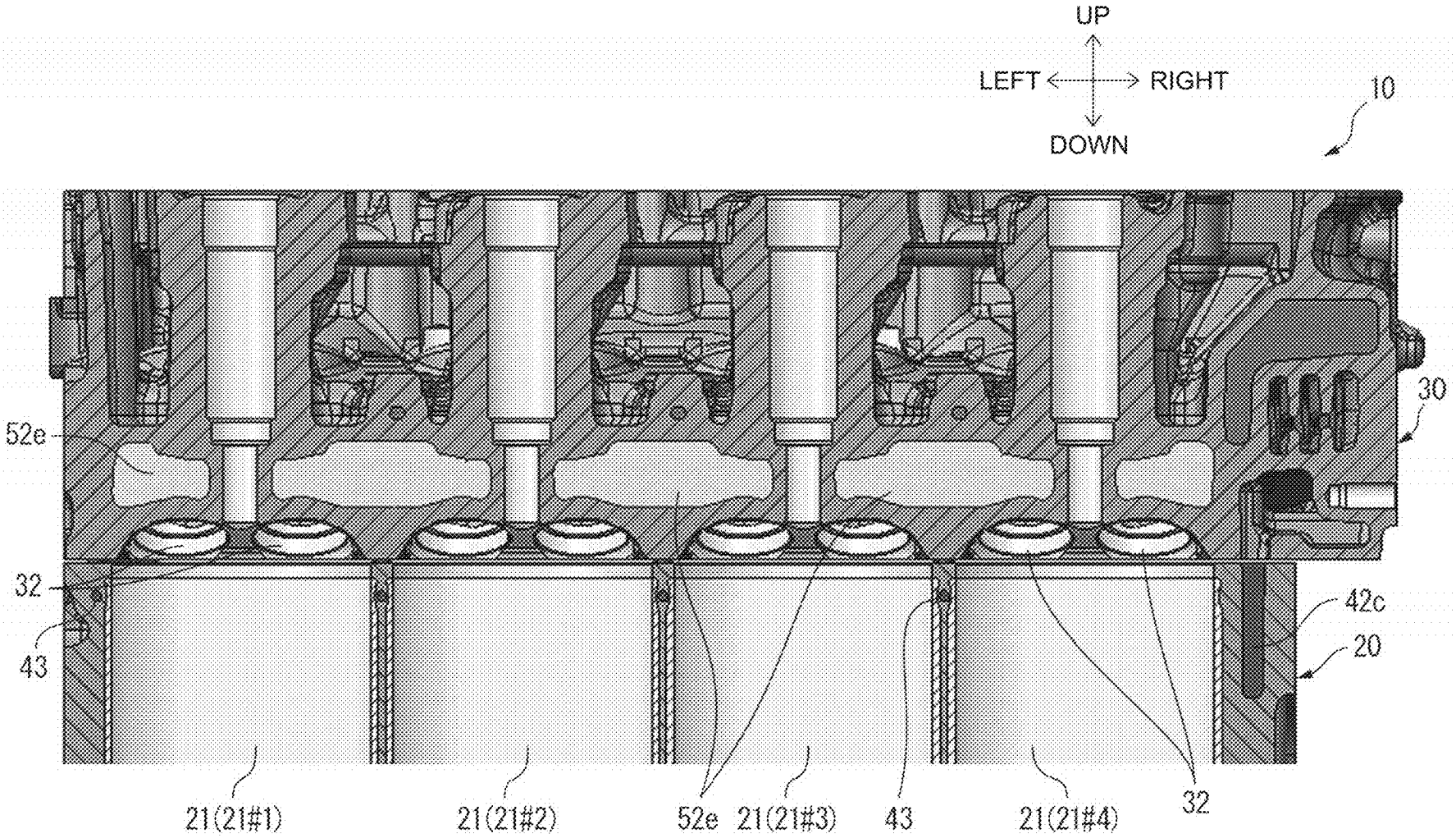
FIG. 13 is a cross-sectional view of the cylinder block and the cylinder head, as viewed along a line XIII-XIII in FIGS. 6 and 7.
Figure 14:
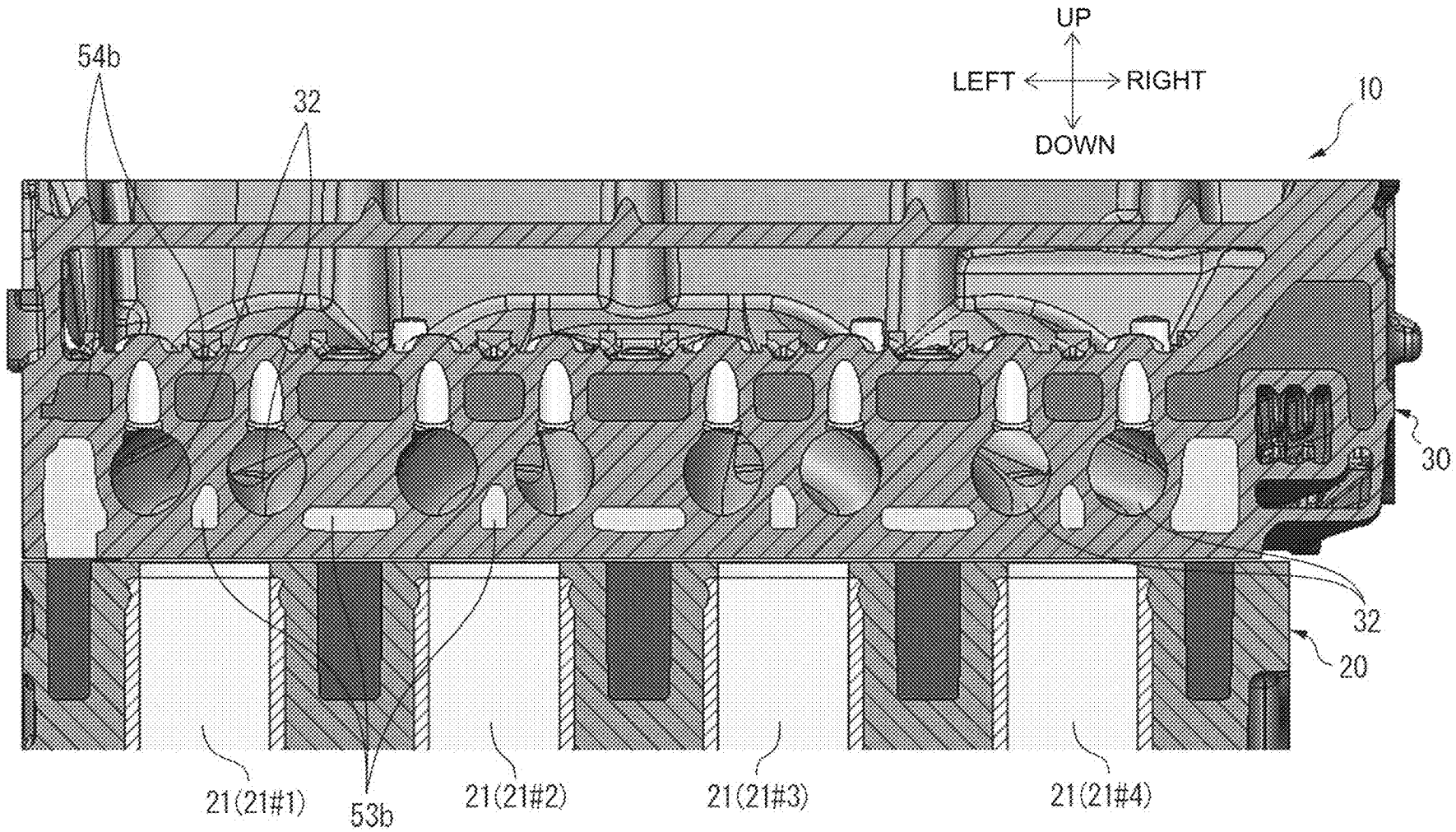
FIG. 14 is a cross-sectional view of the cylinder block and the cylinder head, as viewed along a line IXV-IXV in FIGS. 6 and 7.

It should be noted herein that FIG. 9 is a cross-sectional view of the cylinder block 20 and the cylinder head 30 as viewed along a line IX-IX in FIGS. 6 and 7, that FIG. 10 is a cross-sectional view of the cylinder block 20 and the cylinder head 30 as viewed along a line X-X in FIGS. 6 and 7, and that FIG. 11 is a cross-sectional view of the cylinder block 20 and the cylinder head 30 as viewed along a line XI-XI in FIGS. 6 and 7. Besides, FIG. 12 is a cross-sectional view of the cylinder block 20 and the cylinder head 30 as viewed along a line XII-XII in FIGS. 6 and 7, FIG. 13 is a cross-sectional view of the cylinder block 20 and the cylinder head 30 as viewed along a line XIII-XIII in FIGS. 6 and 7, and FIG. 14 is a cross-sectional view of the cylinder block 20 and the cylinder head 30 as viewed along a line IXV-IXV in FIGS. 6 and 7. Further, FIGS. 6 and 7 show the water jackets that are provided in the cylinder block 20 and the cylinder head 30 respectively, and FIGS. 9 to 14 show the cross-sections of the cylinder block 20 and the cylinder head 30 themselves.

As shown in FIGS. 2 to 8, the cylinder head 30 includes the in-head water jacket 51. The in-head water jacket 51 mainly includes an intake-side flow passage 52, the first exhaust-side flow passage 53, a second exhaust-side flow passage 54, and an outflow flow passage 55. In FIGS. 2 to 14, the intake-side flow passage 52 and the first exhaust-side flow passage 53 are depicted gray with the same concentration, and the second exhaust-side flow passage 54 and the outflow flow passage 55 are depicted gray with a concentration higher than the concentration of the intake-side flow passage 52 and the first exhaust-side flow passage 53.

The intake-side flow passage 52 is provided around intake ports 31 (e.g., see FIGS. 10 and 12). Both the first exhaust-side flow passage 53 and the second exhaust-side flow passage 54 are provided around exhaust ports 32 (e.g., see FIGS. 10, 13, and 14). In particular, the first exhaust-side flow passage 53 has a region that is located below the exhaust ports 32 (i.e., on the cylinder block side), and the second exhaust-side flow passage 54 has a region that is located above the exhaust ports 32 (i.e., on the opposite side of the cylinder block).

As shown in FIG. 3, the intake-side flow passage 52 includes intake inter-cylinder flow passages 52*a*, end portion flow passages 52*b*, inter-intake port flow passages 52*c*, head inlet flow passages 52*d*, and cylinder upper flow passages 52*e*. Each of the intake inter-cylinder flow passages 52*a* is provided in the cylinder head 30 in such a manner as to extend across an area between two adjacent ones of the intake ports 31 that communicate with adjacent ones of the cylinders 21 respectively (in other words, each of the intake inter-cylinder flow passages 52*a* is provided in the cylinder head 30 in such a manner as to extend in the longitudinal direction between two adjacent ones of the intake ports 31 that communicate with adjacent ones of the cylinders 21 respectively). The end portion flow passages 52*b* are provided on the left side of the intake port 31 that communicates with the cylinder 21 (21#1) at the left end, and on the right side of the intake port that communicates with the cylinder (21#4) at the right end, respectively. Besides, each of the inter-intake port flow passages 52*c* is provided in the cylinder head 30 in such a manner as to extend across an area between the plurality of the intake ports 31 that communicate with one of the cylinders (in other words, each of the inter-intake port flow passages 52*c* is provided in the cylinder head 30 in such a manner as to extend in the longitudinal direction between the plurality of the intake ports 31 that communicate with one of the cylinders). In the present embodiment, each of the inter-intake port flow passages 52*c* is provided such that the minimum flow passage cross-sectional area thereof is smaller than the minimum flow passage cross-sectional area of the corresponding one of the intake inter-cylinder flow passages 52*a* and the minimum flow passage cross-sectional area of the corresponding one of the end portion flow passages 52*b*.

Each of the head inlet flow passages 52*d* is provided in the cylinder head 30 in such a manner as to extend upward from a lower surface (a surface facing the cylinder block 20) of the cylinder head 30 in the axial direction of the cylinders 21. Accordingly, the head inlet flow passages 52*d* are exposed to the lower surface of the cylinder head 30. Besides, the head inlet flow passages 52*d* communicate with the intake inter-cylinder flow passages 52*a*, the end portion flow passages 52*b*, and the inter-intake port flow passages 52*c*. In the present embodiment in particular, one or a plurality of (two in the present embodiment) head inlet flow passages 52*d* are provided for each of the cylinders 21, and one of the intake inter-cylinder flow passages 52*a* or one of the end portion flow passages 52*b* and one of the inter-intake port flow passages 52*c* communicate with each of the head inlet flow passages 52*d*. Besides, each of the head inlet flow passages 52*d* is provided in such a manner as to communicate with the opening 41*x* of the corresponding one of the intake-side extended flow passages 41*a* of the first water jacket 41 via the opening that is provided in the gasket 15 when the cylinder head 30 is assembled with the cylinder block 20.

Each of the cylinder upper flow passages 52*e* is provided in the cylinder head 30 in such a manner as to extend in the lateral direction (the alignment direction of the cylinders 21) above a center of the corresponding one of the cylinders 21. Besides, each of the cylinder upper flow passages 52*e* communicates with all of the corresponding one of the intake inter-cylinder flow passages 52*a*, the corresponding one of the end portion flow passages 52*b*, and the corresponding one of the inter-intake port flow passages 52*c*. Each of the cylinder upper flow passages 52*e* communicates with an end of the corresponding one of the intake inter-cylinder flow passages 52*a*, the end being opposite to an end of the corresponding one of the intake inter-cylinder flow passages 52*a* that communicates with the corresponding one of the head inlet flow passages 52*d*. Similarly, each of the cylinder upper flow passages 52*e* communicates with an end of the corresponding one of the end portion flow passages 52*b*, the end being opposite to an end of the corresponding one of the end portion flow passages 52*b* that communicates with the corresponding one of the head inlet flow passages 52*d*, and each of the cylinder upper flow passages 52*e* communicates with an end of the corresponding one of the inter-intake port flow passages 52*c*, the end being opposite to an end of the corresponding one of the inter-intake port flow passages 52*c* that communicates with the corresponding one of the head inlet flow passages 52*d*.

The intake-side flow passage 52 may not necessarily include partially or entirely the inter-intake port flow passages 52*c*. Similarly, the intake-side flow passage 52 may not necessarily include partially or entirely the intake inter-cylinder flow passages 52*a* and the end portion flow passages 52*b*.

As shown in FIGS. 7 and 8, the first exhaust-side flow passage 53 includes inter-exhaust port flow passages 53*a* and port lower flow passages 53*b*. Each of the inter-exhaust port flow passages 53*a* is provided in the cylinder head 30 in such a manner as to extend across an area between the plurality of the exhaust ports 32 that communicate with the corresponding one of the cylinders 21 (in other words, each of the inter-exhaust port flow passages 53*a* is provided in the cylinder head 30 in such a manner as to extend in the longitudinal direction between the plurality of the exhaust ports 32 that communicate with the corresponding one of the cylinders 21). The inter-exhaust port flow passages 53*a* are provided between the exhaust ports 32 as to all the cylinders 21 respectively. Each of the inter-exhaust port flow passages 53*a* is provided in such a manner as to communicate at one end portion thereof with the corresponding one of the cylinder upper flow passages 52*e* of the intake-side flow passage 52.

The port lower flow passages 53*b* are provided in the cylinder head 30 in such a manner as to extend in the lateral direction (in the alignment direction of the cylinders 21) and from the cylinder upper flow passages 52*e* toward the exhaust side, below all the exhaust ports 32 respectively. Besides, the port lower flow passages 53*b* communicate with all the inter-exhaust port flow passages 53*a* respectively. In addition, the port lower flow passages 53*b* are provided in the cylinder head 30 in such a manner as to be exposed to the lower surface of the cylinder head 30. Each of the port lower flow passages 53*b* is provided in such a manner as to communicate with the opening 42*x* of the corresponding one of the exhaust-side extended flow passages 42*a* of the second water jacket 42 when the cylinder head 30 is assembled with the cylinder block 20.

Besides, in the present embodiment, as shown in FIGS. 7, 9, and 10, the first exhaust-side flow passage 53 is not provided with a flow passage that extends across an area between two adjacent ones of the exhaust ports 32 that communicate with adjacent ones of the cylinders 21 respectively (in other words, the first exhaust-side flow passage 53 is not provided with a flow passage that extends in the longitudinal direction between two adjacent ones of the exhaust ports 32 that communicate with adjacent ones of the cylinders 21 respectively). Accordingly, the entire coolant flowing from each of the cylinder upper flow passages 52*e* of the intake-side flow passage 52 to the corresponding one of the port lower flow passages 53*b* of the first exhaust-side flow passage 53 flows through the corresponding one of the inter-exhaust port flow passages 53*a* that extends across an area between the plurality of the exhaust ports 32 that communicate with the corresponding one of the cylinders 21. In other words, the entire coolant flowing from each of the cylinder upper flow passages 52*e* of the intake-side flow passage 52 to the corresponding one of the port lower flow passages 53*b* of the first exhaust-side flow passage 53 flows through the corresponding one of the inter-exhaust port flow passages 53*a* that extends in the longitudinal direction between the plurality of the exhaust ports 32 that communicate with the corresponding one of the cylinders 21.

The exhaust-side flow passage 53 may have an exhaust inter-cylinder flow passage that extends across an area between two adjacent ones of the exhaust ports 32 that communicate with adjacent ones of the cylinders 21 respectively. In other words, the exhaust-side flow passage 53 may have an exhaust inter-cylinder flow passage that extends in the longitudinal direction between two adjacent ones of the exhaust ports 32 that communicate with adjacent ones of the cylinders 21 respectively. However, that the exhaust inter-cylinder flow passages are provided such that the total flow passage cross-sectional area thereof is smaller than the total flow passage cross-sectional area of the inter-exhaust port flow passages 53*a* in this case. In other words, the exhaust inter-cylinder flow passages are provided such that the flow rate of coolant flowing through each of the exhaust inter-cylinder flow passages is lower than the flow rate of coolant flowing through the corresponding one of the inter-exhaust port flow passages 53*a*.

The second exhaust-side flow passage 54 includes cylindrical communication flow passages 54*a* and port upper flow passages 54*b*. Each of the cylindrical communication flow passages 54*a* communicates with the corresponding one of the cylinder upper flow passages 52*e*, and extends upward from the corresponding one of the cylinder upper flow passages 52*e*. In the present embodiment, each of the cylindrical communication flow passages 54*a* is provided in the cylinder head 30 above a space between adjacent ones of the cylinders 21. The cylindrical communication flow passages 54*a* are provided with solid cylindrical shaft-like flow rate adjustment portions 56 respectively (see FIGS. 9 and 11). By providing the flow rate adjustment portions 56 in the cylindrical communication flow passages 54*a* respectively, the minimum flow passage cross-sectional area in each of the cylindrical communication flow passages 54*a* is small.

The port upper flow passages 54*b* are provided in the cylinder head 30 in such a manner as to extend in the lateral direction (in the alignment direction of the cylinders 21) and from the cylindrical communication flow passages 54*a* toward the exhaust side above all the exhaust ports 32 respectively. Each of the port upper flow passages 54*b* communicates at the intake-side end portion thereof with the corresponding one of the cylindrical communication flow passages 54*a*.

As shown in FIG. 3 in particular, the outflow flow passage 55 includes an aggregate flow passage 55*a*, an outlet flow passage 55*b*, a first outflow port 55*c*, a second outflow port 55*d*, and a third outflow port 55*e*. The aggregate flow passage 55*a* communicates with the port lower flow passages 53*b* of the first exhaust-side flow passage 53 and the port upper flow passages 54*b* of the second exhaust-side flow passage 54. In particular, the aggregate flow passage 55*a* communicates with the port lower flow passages 53*b* at rear ends thereof, and communicates with the port upper flow passages 54*b* at rear ends thereof. The aggregate flow passage 55*a* is provided in the cylinder head 30 in such a manner as to extend in the lateral direction (in the alignment direction of the cylinders 21) from a region corresponding to the first cylinder 21#1 to a region corresponding to the fourth cylinder 21#4.

The outlet flow passage 55*b* is provided in the cylinder head 30 in such a manner as to longitudinally extend on a right end side of the aggregate flow passage 55*a*. The outlet flow passage 55*b* is provided in such a manner as to communicate with the right end of the aggregate flow passage 55*a*. Besides, the outlet flow passage 55*b* is provided in such a manner as to communicate with the discharge portion 42*d* of the second water jacket 42 when the cylinder head 30 is assembled with the cylinder block 20.

Each of the first outflow port 55*c*, the second outflow port 55*d*, and the third outflow port 55*e* is provided in such a manner as to communicate at one end portion thereof with the outlet flow passage 55*b*, and to communicate at the other end portion thereof with the outside of the cylinder head 30. In the present embodiment in particular, the first outflow port 55*c* is provided in such a manner as to extend rightward from a rear end of the outlet flow passage 55*b*. The second outflow port 55*d* is provided in such a manner as to extend rightward from a front end portion of the outlet flow passage 55*b*. The third outflow port 55*e* is provided in such a manner as to extend forward from a front end of the outlet flow passage 55*b*. Besides, the third outflow port 55*e* is provided such that the flow passage cross-sectional area thereof is larger than the flow passage cross-sectional area of the first outflow port 55*c* and the flow passage cross-sectional area of the second outflow port 55*d*. This first outflow port 55*c*, this second outflow port 55*d*, and this third outflow port 55*e* communicate with the coolant discharge passage 2*b*. Accordingly, coolant flows out from the engine body 10 to the first outflow port 55*c*, the second outflow port 55*d*, and the third outflow port 55*e*.

Figure 15:
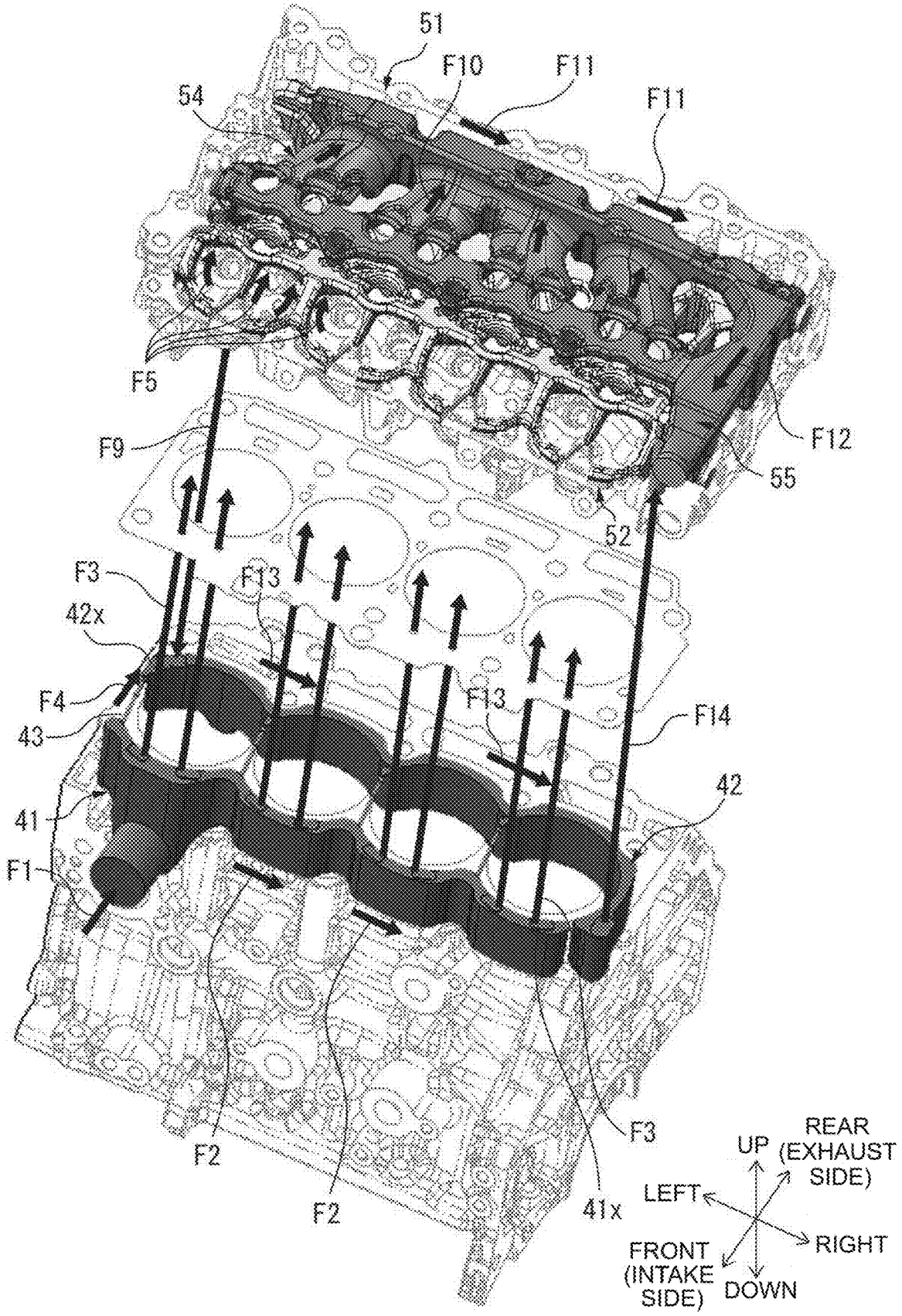
FIG. 15 is a perspective view similar to FIG. 2, schematically showing the cylinder block and the cylinder head.
Figure 16:
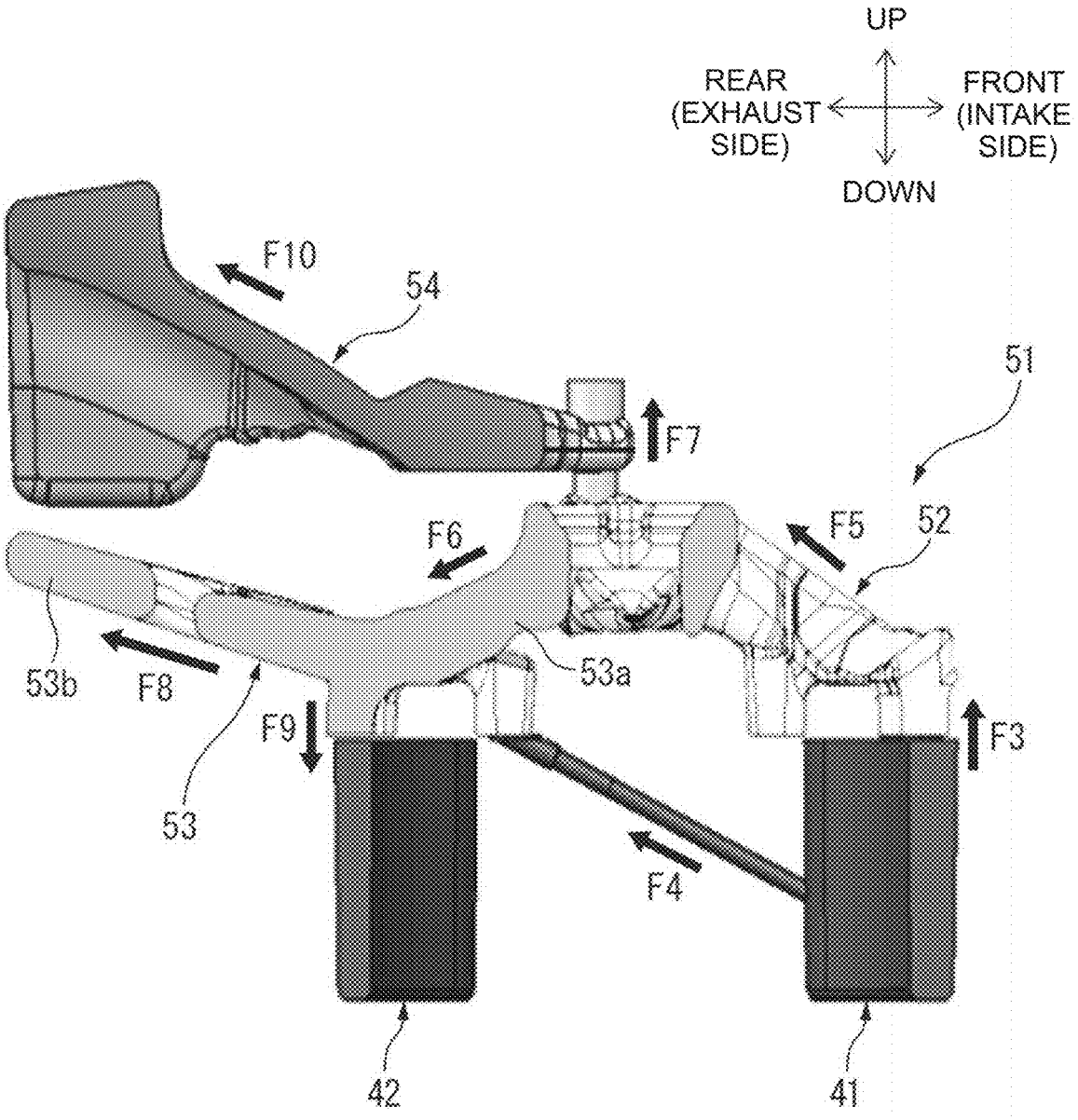
FIG. 16 is a cross-sectional view similar to FIG. 8, showing the water jackets that are provided in the cylinder block and the cylinder head respectively.

Next, the flow of coolant in the water jackets in the cylinder block 20 and the cylinder head 30 will be described with reference to FIGS. 15 and 16. FIG. 15 is a perspective view similar to FIG. 2, schematically showing the cylinder block and the cylinder head. FIG. 16 is a cross-sectional view similar to FIG. 8, showing the water jackets that are provided in the cylinder block and the cylinder head respectively. Arrows in FIGS. 15 and 16 indicate how coolant flows in the water jackets.

In the present embodiment, only the inflow port 41*b* of the first water jacket 41 that is provided in the cylinder block 20 communicates with the coolant introduction passage 2*a*. Accordingly, the entire coolant flows in from the inflow port 41*b* of the first water jacket 41 that is provided in the cylinder block 20 (as indicated by an arrow F1 in FIG. 15).

The coolant that has flowed into the inflow port 41*b* then flows into the intake-side extended flow passages 41*a* of the first water jacket 41, and spreads into the intake-side extended flow passages 41*a*. Specifically, the coolant that has flowed into the intake-side extended flow passages 41*a* of the first water jacket 41 flows rightward (in a direction away from the inflow port 41*b*) (as indicated by arrows F2 in FIG. 15).

Much of the coolant that has spread into the intake-side extended flow passages 41*a* flows upward, and flows into the intake-side flow passage 52 of the in-head water jacket 51 of the cylinder head 30 via the opening 41*x* in the first water jacket 41. More specifically, this coolant flows into the head inlet flow passages 52*d* of the intake-side flow passage 52 (as indicated by arrows F3 in FIGS. 15 and 16).

On the other hand, part of the coolant that has spread into the intake-side extended flow passage 41*a* flows into the small-diameter flow passages 43. The coolant that has flowed into the small-diameter flow passages 43 flows in the small-diameter flow passages 43 from the intake-side extended flow passage 41*a* sides toward the first exhaust-side flow passage 53 of the in-head water jacket 51 (as indicated by an arrow F4 in FIGS. 15 and 16). Thus, each wall that is provided between adjacent ones of the cylinders 21 is cooled.

The cylinder block 20 and the cylinder head 30 are provided such that the flow rate of the coolant that directly flows into the intake-side flow passage 52 (the coolant flowing in the direction indicated by the arrows F3) after flowing into the first water jacket 41 is higher than the flow rate of coolant that directly flows into any region other than the intake-side flow passage 52. In the present embodiment, the cylinder block 20 is provided such that coolant flows out from the first water jacket 41 only to the intake-side flow passage 52 and the small-diameter flow passages 43. Accordingly, the coolant that directly flows into any region other than the above-mentioned intake-side flow passage 52 means the coolant that flows into the small-diameter flow passages 43 (that flows in the direction indicated by the arrow F4).

In particular, the cylinder block 20 and the cylinder head 30 are preferably provided such that the flow rate of the coolant that directly flows from the first water jacket 41 into the intake-side flow passage 52 is equal to or higher than 80% of the total flow rate of the entire coolant that flows out from the first water jacket 41. The cylinder block 20 and the cylinder head 30 are more preferably provided such that the flow rate of the coolant that directly flows from the first water jacket 41 into the intake-side flow passage 52 is equal to or higher than 90% of the total flow rate of the entire coolant that flows out from the first water jacket 41.

Specifically, in the present embodiment, the cylinder block 20 and the cylinder head 30 are provided such that the total flow passage cross-sectional area of the flow passages through which coolant passes in flowing out from the first water jacket 41 to the intake-side flow passage 52 is larger than the total flow passage cross-sectional area of the flow passages through which coolant passes in flowing out from the first water jacket 41 to any region other than the intake-side flow passage 52 (the small-diameter flow passages 43 in the present embodiment).

In particular, the cylinder block 20 and the cylinder head 30 are preferably provided such that the total flow passage cross-sectional area of the flow passages through which coolant passes in flowing out from the first water jacket 41 to the intake-side flow passage 52 is equal to or larger than 80% of the total flow passage cross-sectional area of all the flow passages through which coolant passes in flowing out from the first water jacket 41. The cylinder block 20 and the cylinder head 30 are more preferably provided such that the total flow passage cross-sectional area of the flow passages through which coolant passes in flowing out from the first water jacket 41 to the intake-side flow passage 52 is equal to or larger than 90% of the total flow passage cross-sectional area of all the flow passages through which coolant passes in flowing out from the first water jacket 41.

The coolant that has flowed from the intake-side extended flow passages 41*a* of the first water jacket 41 into the head inlet flow passages 52*d* of the intake-side flow passage 52 then flows into the cylinder upper flow passages 52*e* through the intake inter-cylinder flow passages 52*a*, the end portion flow passages 52*b*, and the inter-intake port flow passages 52*c* (as indicated by arrows F5 in FIGS. 15 and 16). In the present embodiment, the minimum flow passage cross-sectional area of each of the inter-intake port flow passages 52*c* is smaller than the minimum flow passage cross-sectional area of each of the intake inter-cylinder flow passages 52*a* and the minimum flow passage cross-sectional area of each of the end portion flow passages 52*b*. Therefore, more coolant flows through the intake inter-cylinder flow passages 52*a* and the end portion flow passages 52*b* than through the inter-intake port flow passages 52*c*. Further, the minimum flow passage cross-sectional area of each of the inter-intake port flow passages 52*c* may be larger than the minimum flow passage cross-sectional area of each of the intake inter-cylinder flow passages 52*a* and the minimum flow passage cross-sectional area of each of the end portion flow passages 52*b*. In this case, more coolant flows through the inter-intake port flow passages 52*c* than through the intake inter-cylinder flow passages 52*a* and the end portion flow passages 52*b*.

Coolant flows into the intake inter-cylinder flow passages 52*a*, the end portion flow passages 52*b*, and the inter-intake port flow passages 52*c* of the intake-side flow passage 52 that extends around the intake ports 31, only through the first water jacket 41. Accordingly, the low-temperature coolant that has hardly been warmed by the engine body 10 flows into these flow passages 52*a*, 52*b*, and 52*c*. Therefore, the intake gas that flows into the cylinders 21 through the intake ports 31 can be cooled by coolant (or intake gas is restrained from being heated in the intake ports 31). As a result, the temperature of intake gas sucked into the cylinders 21 can be held low. Thus, the occurrence of knocking can be suppressed. In consequence, according to the present embodiment, low-temperature coolant can be supplied to those spots of the cylinder head 30 which are required to be cooled. Thus, the cylinder head 30 can be appropriately cooled.

In the present embodiment in particular, the intake-side flow passage 52 includes the inter-intake port flow passages 52*c* each of which extends between the plurality of the intake ports that communicate with the corresponding one of the cylinders 21. Therefore, the wall surfaces of the intake ports 31 can be more effectively cooled. In addition, the intake-side flow passage 52 includes the intake inter-cylinder flow passages 52*a* and the end portion flow passages 52*b*, so the flow passages for coolant are provided in such a manner as to cover the respective intake ports 31. Thus, the wall surfaces of the intake ports 31 can be more effectively cooled. As a result, the temperature of intake gas sucked into the cylinders 21 can be held low, so the occurrence of knocking can be suppressed.

Part of the coolant that has flowed into the cylinder upper flow passages 52*e* of the intake-side flow passage 52 then flows into the inter-exhaust port flow passages 53*a* of the first exhaust-side flow passage 53 (as indicated by an arrow F6 in FIG. 16), and the rest of the coolant then flows into the cylindrical communication flow passages 54*a* of the second exhaust-side flow passage 54 (as indicated by an arrow F7 in FIG. 16).

In the present embodiment, the cylinder head 30 is provided such that the flow rate of coolant flowing from the cylinder upper flow passages 52*e* into the inter-exhaust port flow passages 53*a* is higher than the flow rate of coolant flowing from the cylinder upper flow passages 52*e* into the cylindrical communication flow passages 54*a*. In particular, the cylinder head 30 is preferably provided such that the flow rate of coolant flowing from the cylinder upper flow passages 52*e* to the inter-exhaust port flow passages 53*a* is equal to or higher than 65% of the total flow rate of the entire coolant flowing out from the cylinder upper flow passages 52*e*. The cylinder head 30 is more preferably provided such that the flow rate of coolant flowing from the cylinder upper flow passages 52*e* to the inter-exhaust port flow passages 53*a* is equal to or higher than 80% of the total flow rate of the entire coolant flowing out from the cylinder upper flow passages 52*e*.

In the present embodiment, the minimum flow passage cross-sectional area of each of the cylindrical communication flow passages 54*a* is adjusted by the corresponding one of the cylindrical shaft-like flow rate adjustment portions 56 that is provided in each of the cylindrical communication flow passages 54*a*. Specifically, in the present embodiment, the cylinder head 30 is provided such that the total flow passage cross-sectional area of the flow passages through which coolant passes in flowing out from the cylinder upper flow passages 52*e* to the inter-exhaust port flow passages 53*a* is larger than the total cross-sectional area of the flow passages through which coolant passes in flowing out from the cylinder upper flow passages 52*e* to the cylindrical communication flow passages 54*a*. In particular, the cylinder head 30 is preferably provided such that the total flow passage cross-sectional area of the flow passages through which coolant passes in flowing out from the cylinder upper flow passages 52*e* to the inter-exhaust port flow passages 53*a* is equal to or larger than 65% of the total flow passage cross-sectional area of all the flow passages through which coolant passes in flowing out from the cylinder upper flow passages 52*e*. The cylinder head 30 is more preferably provided such that the total flow passage cross-sectional area of the flow passages through which coolant passes in flowing out from the cylinder upper flow passages 52*e* to the inter-exhaust port flow passages 53*a* is equal to or larger than 80% of the total flow passage cross-sectional area of all the flow passages through which coolant passes in flowing out from the cylinder upper flow passages 52*e*. Further, the minimum flow passage cross-sectional area of each of the cylindrical communication flow passages 54*a* may be adjusted by changing the cross-sectional area of each of the cylindrical communication flow passages 54*a* itself, without recourse to the corresponding one of the flow rate adjustment portions 56.

Besides, part of the coolant that has flowed from the cylinder upper flow passages 52*e* into the inter-exhaust port flow passages 53*a* (as indicated by the arrow F6 in FIG. 16) then flows into the port lower flow passages 53*b* (as indicated by an arrow F8 in FIG. 16), and the rest of the coolant then flows into the second water jacket 42 of the cylinder block 20 via the opening 42*x* (as indicated by an arrow F9 in FIG. 16). On the other hand, the coolant that has flowed from the cylinder upper flow passages 52*e* into the cylindrical communication flow passages 54*a* (as indicated by the arrow F7 in FIG. 16) then flows into the port upper flow passages 54*b* (as indicated by an arrow F10 in FIG. 16).

The coolant thus flows through the inter-exhaust port flow passages 53*a* of the first exhaust-side flow passage 53, and that region of the cylinder head 30 which faces the cylinders 21 is thereby cooled. As a result, the temperature of gas in the cylinders 21 is unlikely to be raised. In consequence, the occurrence of knocking in the cylinders 21 can be suppressed. In the present embodiment in particular, as shown in FIG. 7, the first exhaust-side flow passage 53 does not include a flow passage that extends across an area between two adjacent ones of the exhaust ports 32 that communicate with adjacent ones of the cylinders 21 respectively (in other words, the first exhaust-side flow passage 53 does not include a flow passage that extends in the longitudinal direction between two adjacent ones of the exhaust ports 32 that communicate with adjacent ones of the cylinders 21 respectively). Therefore, the flow rate of coolant flowing through the inter-exhaust port flow passages 53*a* is high. As a result, that region of the cylinder head 30 which faces the cylinders 21 can be more reliably cooled. In consequence, the occurrence of knocking in the cylinders 21 can be suppressed.

Besides, in the present embodiment, the coolant that has flowed through the first water jacket 41 and the intake-side flow passage 52 in the cylinder block 20 flows into the port lower flow passages 53*b* and the port upper flow passages 54*b*. Accordingly, the coolant that has become somewhat warm flows into the port lower flow passages 53*b* and the port upper flow passages 54*b*. As a result, the exhaust gas flowing in the exhaust ports 32 is not necessarily cooled too much during warm-up or the like of the internal combustion engine. Therefore, the temperature of a catalyst (not shown) into which the exhaust gas that has flowed out from the exhaust ports 32 flows is easy to raise and hold equal to or higher than an activation temperature.

The coolant that has flowed into the port lower flow passages 53*b* and the port upper flow passages 54*b* flows backward through these flow passages, and soon flows into the aggregate flow passage 55*a* of the outflow flow passage 55. The coolant that has flowed into the aggregate flow passage 55*a* basically flows rightward in the aggregate flow passage 55*a* (as indicated by arrows F11 in FIG. 15), and then flows into the outlet flow passage 55*b*. The coolant that has flowed into the outlet flow passage 55*b* basically flows forward in the outlet flow passage 55*b* (as indicated by an arrow F12 in FIG. 15), and flows out from the third outflow port 55*e* to the coolant discharge passage 2*b*. Besides, part of the coolant that flows through the aggregate flow passage 55*a* and the outlet flow passage 55*b* flows out from the first outflow port 55*c* and the second outflow port 55*d* to the coolant discharge passage 2*b*.

On the other hand, the coolant that has flowed from the inter-exhaust port flow passages 53*a* into the second water jacket 42 of the cylinder block 20 (as indicated by the arrow F9 in FIG. 16) flows rightward through the exhaust-side extended flow passages 42*a* (as indicated by arrows F13 in FIG. 15), and then flows into the lateral extended flow passage 42*c*. The coolant that has flowed into the lateral extended flow passage 42*c* flows forward to the discharge portion 42*d*, and flows upward from the discharge portion 42*d* into the outlet flow passage 55*b* (as indicated by an arrow F14 in FIG. 15). The coolant that has flowed into the outlet flow passage 55*b* flows out from the third outflow port 55*e* to the coolant discharge passage 2*b*.

What is claimed is:

1. An internal combustion engine body comprising:

a cylinder block including:

a first water jacket having an inflow port into which coolant flows from an outside of the internal combustion engine body, a second water jacket, the first water jacket and the second water jacket being provided around a plurality of cylinders, the first water jacket and the second water jacket having respective ends in a longitudinal direction of the cylinder block, and each of the respective ends of the first water jacket and the second water jacket are separated from each other in the longitudinal direction, and a small-diameter flow pipe having a maximum diameter that is smaller than a minimum thickness between adjacent ones of the plurality of the cylinders, the small-diameter flow pipe being an enclosed pipe having a first end connected to the first water jacket and a second end connected to the second water jacket, such that the first water jacket and the second water jacket only indirectly fluidly communicate with each other through the small-diameter flow pipe, or the small-diameter flow pipe connecting to a region of an in-head water jacket other than an intake-side flow passage; and a cylinder head including the in-head water jacket, the in-head water jacket including the intake-side flow passage that includes a dedicated conduit that respectively communicates with the first water jacket and the second water jacket, and the intake-side flow passage is provided around an intake port, wherein:

at least part of the first water jacket is provided on intake sides of the plurality of the cylinders, at least part of the second water jacket is provided on exhaust sides of the plurality of the cylinders, the cylinder block and the cylinder head are provided such that a flow rate of the coolant that directly flows into the intake-side flow passage after flowing into the first water jacket is higher than a flow rate of the coolant that directly flows into any region other than the intake-side flow passage after flowing into the first water jacket, each of the intake sides of the plurality of the cylinders is a side where the intake port is provided with respect to a plane containing axes of the plurality of the cylinders in a direction perpendicular to the plane, and each of the exhaust sides of the plurality of the cylinders is a side where an exhaust port is provided with respect to the plane, and the cylinder block is provided such that the coolant flows out from the first water jacket only to the intake-side flow passage and the small-diameter flow pipe.

2. The internal combustion engine body according to claim 1, wherein a plurality of the small-diameter flow pipes are provided.

3. The internal combustion engine body according to claim 1, wherein the intake-side flow passage includes an inter-intake port flow passage that extends across an area between a plurality of intake ports that communicate with one of the plurality of the cylinders.

4. The internal combustion engine body according to claim 3, wherein the intake-side flow passage includes an intake inter-cylinder flow passage that extends across an area between two adjacent intake ports of the plurality of intake ports that communicate with adjacent cylinders of the plurality of the cylinders respectively.

5. The internal combustion engine body according to claim 1, wherein the in-head water jacket includes an inter-exhaust port flow passage that extends across an area between a plurality of exhaust ports that communicate with one of the plurality of the cylinders.

6. The internal combustion engine body according to claim 5, wherein the in-head water jacket is not provided with a flow passage that extends across an area between two adjacent ones of the plurality of exhaust ports that communicate with adjacent cylinders of the plurality of the cylinders respectively.

7. The internal combustion engine body according to claim 1, wherein:

the in-head water jacket includes a first exhaust-side flow passage including a portion that is located closer to the cylinder block than the exhaust port is, and a second exhaust-side flow passage including a portion that is located on an opposite side of the exhaust port from the cylinder block, and the cylinder head is provided such that both the first exhaust-side flow passage and the second exhaust-side flow passage communicate with the intake-side flow passage, and the cylinder head is provided such that a flow rate of the coolant flowing from the intake-side flow passage into the first exhaust-side flow passage is higher than a flow rate of the coolant flowing from the intake-side flow passage into the second exhaust-side flow passage.

8. The internal combustion engine body according to claim 1, wherein the second water jacket is not provided with an inflow port into which the coolant flows from the outside of the internal combustion engine body.

9. An internal combustion engine body comprising:

a cylinder block including:

a first water jacket having an inflow port into which coolant flows from an outside of the internal combustion engine body, a second water jacket, the first water jacket and the second water jacket being provided around a plurality of cylinders, the first water jacket and the second water jacket having respective ends in a longitudinal direction of the cylinder block, and each of the respective ends of the first water jacket and the second water jacket are separated from each other in the longitudinal direction, and a small-diameter flow pipe having a maximum diameter that is smaller than a minimum thickness between adjacent ones of the plurality of the cylinders, the small-diameter flow pipe being an enclosed pipe having a first end connected to the first water jacket and a second end connected to the second water jacket, such that the first water jacket and the second water jacket only indirectly fluidly communicate with each other through the small-diameter flow pipe, or the small-diameter flow pipe connecting to a region of an in-head water jacket other than an intake-side flow passage; and a cylinder head including an in-head water jacket, the in-head water jacket including the intake-side flow passage that includes a dedicated conduit that respectively communicates with the first water jacket and the second water jacket, and the intake-side flow passage is provided around an intake port, wherein:

at least part of the first water jacket is provided on intake sides of the plurality of the cylinders, at least part of the second water jacket is provided on exhaust sides of the plurality of the cylinders, the cylinder block and the cylinder head are provided such that a total flow passage cross-sectional area of flow passages through which the coolant passes when the coolant flows out from the first water jacket to the intake-side flow passage is larger than a total flow passage cross-sectional area of flow passages through which the coolant passes when the coolant flows out from the first water jacket to any region other than the intake-side flow passage, each of the intake sides is a side where the intake port is provided with respect to a plane containing axes of the plurality of the cylinders in a direction perpendicular to the plane, and each of the exhaust sides is a side where an exhaust port is provided with respect to the plane, and the cylinder block is provided such that the coolant flows out from the first water jacket only to the intake-side flow passage and the small-diameter flow pipe.

10. The internal combustion engine body according to claim 9, wherein a plurality of the small-diameter flow pipes are provided.

11. The internal combustion engine body according to claim 9, wherein the intake-side flow passage includes an inter-intake port flow passage that extends across an area between a plurality of intake ports that communicate with one of the plurality of the cylinders.

12. The internal combustion engine body according to claim 11, wherein the intake-side flow passage includes an intake inter-cylinder flow passage that extends across an area between two adjacent intake ports of the plurality of intake ports that communicate with adjacent cylinders of the plurality of the cylinders respectively.

13. The internal combustion engine body according to claim 9, wherein the in-head water jacket includes an inter-exhaust port flow passage that extends across an area between a plurality of exhaust ports that communicate with one cylinder of the plurality of the cylinders.

14. The internal combustion engine body according to claim 13, wherein the in-head water jacket is not provided with a flow passage that extends across an area between two adjacent exhaust ports of the plurality of exhaust ports that communicate with adjacent cylinders of the plurality of the cylinders respectively.

15. The internal combustion engine body according to claim 9, wherein:

the in-head water jacket includes a first exhaust-side flow passage including a portion that is located closer to the cylinder block than the exhaust port, and a second exhaust-side flow passage includes a portion that is located on an opposite side of the exhaust port from the cylinder block, and the cylinder head is provided such that both the first exhaust-side flow passage and the second exhaust-side flow passage communicate with the intake-side flow passage, and the cylinder head is provided such that a flow rate of the coolant flowing from the intake-side flow passage into the first exhaust-side flow passage is higher than a flow rate of the coolant flowing from the intake-side flow passage into the second exhaust-side flow passage.

16. The internal combustion engine body according to claim 9, wherein the second water jacket is not provided with an inflow port into which the coolant flows from the outside of the internal combustion engine body.

* * * * *